US011448104B2

(12) United States Patent
Erickson

(10) Patent No.: US 11,448,104 B2
(45) **Date of Patent: *Sep. 20, 2022**

(54) TYPE II VALVETRAIN AND HYDRAULIC ENGINE BRAKE ARRANGEMENT

(71) Applicant: Deere & Company, Moline, IL (US)

(72) Inventor: Neil S. Erickson, Denver, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/503,911

(22) Filed: Oct. 18, 2021

(65) Prior Publication Data

US 2022/0268183 A1 Aug. 25, 2022

Related U.S. Application Data

(63) Continuation of application No. 17/185,536, filed on Feb. 25, 2021, now Pat. No. 11,181,018.

(51) Int. Cl.
*F02D 1/00* (2006.01)
*F01L 13/06* (2006.01)
(Continued)

(52) U.S. Cl.
CPC ..... *F01L 13/065* (2013.01); *F01L 1/185* (2013.01); *F01L 1/2411* (2013.01); *F01L 13/0026* (2013.01); *F01L 2305/00* (2020.05)

(58) Field of Classification Search
CPC ..... F01L 13/06; F01L 13/065; F01L 13/08; F02D 9/06; F02D 13/04; F02D 13/0207; F02D 13/0246; F02D 2041/001
(Continued)

(56) References Cited

U.S. PATENT DOCUMENTS 4,796,573 A 1/1989 Wakeman et al.
4,807,576 A 2/1989 Sonoda et al.
(Continued)

FOREIGN PATENT DOCUMENTS

CN 107060940 A 8/2017
WO 9112415 A1 8/1991
WO 2020221477 A1 5/2020

OTHER PUBLICATIONS

Eaton, Switching Roller Finger Follower, Cyinder Deactivation, https://www.eaton.com/de/de-de/catalog/engine-valvetrain/switching-roller-finger-follower.html, 2021.
(Continued)

*Primary Examiner* — John Kwon
(74) *Attorney, Agent, or Firm* — Klintworth & Rozenblat IP LLP

(57) ABSTRACT

A Type II valvetrain and engine brake arrangement includes a hydraulic brake housing mountable to a valve block of the engine. A brake piston is coupled to a brake rod and a brake cam lobe and is movable between an activated position and a non-activated position. A finger follower is disposed relative to the brake housing so that the brake rod engages the finger follower at least when the brake piston is in the activated position. When the brake piston is in a non-activated position, the finger follower is configured to pivot about a pivot as the finger follower follows a valve cam lobe to effect lifting and seating of a cylinder valve of an engine cylinder. When the brake piston is in the activated position, the finger follower, at least in part, pivots from about the pivot and the brake rod engages an end of the finger follower to lift the cylinder valve and release compression from the engine cylinder.

8 Claims, 20 Drawing Sheets

(51) Int. Cl.

| | |
|---|---|
| ***F01L 1/18*** | (2006.01) |
| ***F01L 13/00*** | (2006.01) |
| ***F01L 1/24*** | (2006.01) |

(58) Field of Classification Search
USPC ..... 123/319–323
See application file for complete search history.

(56) References Cited

U.S. PATENT DOCUMENTS

| | | | | |
|---|---|---|---|---|
| 5,022,360 | A | 6/1991 | Cholewczynski | |
| 5,462,025 | A | 10/1995 | Israel et al. | |
| 7,284,533 | B1 | 10/2007 | Huang et al. | |
| 9,581,058 | B2 | 2/2017 | Radulescu et al. | |
| 10,598,054 | B2 | 3/2020 | Swehla | |
| 10,626,763 | B2 | 4/2020 | Jo et al. | |
| 2014/0305398 | A1 | 10/2014 | Gonsowski et al. | |
| 2016/0376935 | A1 | 12/2016 | Erickson et al. | |
| 2019/0145288 | A1* | 5/2019 | VanWingerden ..... | F01L 1/18 123/90.16 |
| 2019/0264584 | A1 | 8/2019 | Baltrucki et al. | |
| 2020/0088073 | A1 | 3/2020 | Baltrucki et al. | |
| 2020/0182107 | A1 | 6/2020 | Mandell et al. | |
| 2020/0291826 | A1 | 9/2020 | Mandell et al. | |
| 2021/0095584 | A1* | 4/2021 | Vanwingerden ..... | F01L 1/2405 |
| 2021/0324770 | A1* | 10/2021 | McCarthy, Jr. ..... | F01L 1/053 |

OTHER PUBLICATIONS

Jacobs Vehicle Systems Model 720 Engine Brake—YouTube, https://www.youtube.com/watch?v-z_Q17dPYSJs, May 9, 2011.

Jacobs Vehicle Systems Theory and Operation of The Jake Brake Engine Brake—YouTube, https://www.youtube.com/vatch?v=7FSkNSOeTWM, Feb. 7, 2011.

Jacobs Vehicle Systems Engine Brake Installation Manual Models 675/675A,1992.

Jacobs Vehicle Systems, Jacobs Introduces 1.5 Stroke HPD (High Power Density) Engine Brake, Jacobs Introduces 1.5 Stroke HPD (High Power Density) Engine Brake, May 16, 2018, https://www.jacobsvehiclesystems.com/news-events/jacobs-introduces-15-stroke-hpd-high-power-density-engine-brake, © 2021 Jacobs Vehicle Systems, Inc.

Jacobs Vehicle Systems Maxxforce Engine Brake by Jacobs—YouTube, https://www.youtube.com/watch?v=a3NgHCeCN60, May 9, 2011.

Valvetrain Types,Type II Lash Adjuster Rocker Shaft.

Valvetrain, Wikipedia, https://en.wikipedia.org/wiki/Valvetrain, Apr. 16, 2020.

* cited by examiner

TYPE II VALVETRAIN AND HYDRAULIC ENGINE BRAKE ARRANGEMENT

CROSS-REFERENCE TO RELATED APPLICATION(S)

This is a continuation application of application Ser. No. 17/185,536, filed Feb. 25, 2021.

STATEMENT OF FEDERALLY SPONSORED RESEARCH OR DEVELOPMENT

Not applicable.

FIELD OF THE DISCLOSURE

This disclosure relates to internal combustion engines and, more particularly, to engine brakes for engine with TYPE II valvetrains.

BACKGROUND OF THE DISCLOSURE

Various valvetrains are employed in internal combustion engine designs to transmit reciprocal motion to open and close the valves of engine cylinders for the admission of combustion air and the expulsion of exhaust gases. Generally, the various valvetrains for engine architectures have been classified as Type I, II, III, IV or V. The five types of valvetrains may offer different performance characteristics suitable for certain engine architectures and end-use applications. For example, a Type II valvetrain configuration may have the advantages of relatively low friction, high stiffness, low reciprocating mass, compact packaging and low cost. Other valvetrains types may offer other advantages. The valvetrain types are generally defined by the presence of a main rocker or follower component, the location of pivot of such a rocker or follower, the presence of an additional follower between the main rocker or follower and the camshaft/cam lobe, and the presence of a push rod between the main rocker or follower and the camshaft/cam lobe. For example, Type II valvetrains may generally be classified as valvetrains that employ a rocker or follower intermediate the camshaft/cam lobe and the valve in which the rocker or follower pivots at one end during rotation of the camshaft/cam lobe to impart reciprocal motion to the valve. There is neither a push rod nor an extra follower between the rocker or follower and the camshaft/cam lobe. Further, Type II valvetrains come in two varieties, either being shaft mounted or pivot mounted (e.g., at a lash adjuster) at the end of the rocker or follower opposite the valve.

Further, various vehicle applications employ various techniques to absorb or retard kinetic energy of a vehicle in an effort to slow the vehicle intrinsically without employing external braking features (e.g., friction brakes at the wheels). For vehicles powered by internal combustion engines, engine brakes have been employed for such purposes. Various engine brakes are available including devices that operate to open one or more valves of one or more engine cylinders and thereby decompress the cylinders. Such compression release engine brakes absorb the vehicle's energy by applying it to the work involved in compressing air in the cylinders and releasing it as exhaust before a power stroke can be achieved. While engine brakes are known, various types of engine brakes, including compression release engine brakes, may not be suitable for use with various types of valvetrains.

SUMMARY OF THE DISCLOSURE

The disclosure provides an engine and engine brake and valvetrain arrangement for hydraulically-actuated compression release engine braking in Type II valvetrain engine applications.

In one aspect, the disclosure provides a Type II valvetrain and engine brake arrangement. The arrangement includes a brake housing mountable within a valve block of the engine and defining, at least in part, a hydraulic circuit, the brake housing defining a follower piston chamber and a brake piston chamber in communication with the hydraulic circuit. A follower piston is disposed in the follower piston chamber, and a brake piston is disposed in the brake piston chamber. The follower piston is configured to move between an extended position in which follower piston follows a rotating brake cam lobe and a retracted position in which the follower piston does not follow the rotating brake cam lobe. The brake piston is in pressure responsive relation with the follower piston to move. A brake rod is coupled to the brake piston. A finger follower has a first end and a second end. The finger follower is disposed relative to the brake housing so that the brake rod engages the finger follower at least when the follower piston is in the retracted position. When the follower piston is in the retracted position, the finger follower is configured to pivot from the first end about a pivot as the finger follower follows a valve cam lobe to effect lifting and seating of a cylinder valve of an engine cylinder. When the follower piston is in the extended position, the finger follower, at least in part, pivots from the first end about the pivot and the brake rod moves the second end of the finger follower to lift the cylinder valve and release compression from the engine cylinder.

In another aspect, the disclosure provides an engine with an engine crankcase housing one or more engine cylinders each containing an engine piston and a valve block mounted to the engine crankcase and defining a plurality of valve openings in communication with each of the one or more engine cylinders. The valve block houses a Type II valvetrain, which includes a plurality of camshafts with a plurality of cam lobes disposed above the one or more engine cylinders. The plurality of cam lobes include at least one brake cam lobe and multiple valve cam lobes. The Type II valvetrain further includes a plurality of valves operable to open and close the plurality of valve openings of the one or more engine cylinders, along with a plurality of pivots and a plurality of finger followers configured to pivot about the plurality of pivots and follow the valve cam lobes to effect lifting and seating of the plurality of valves with respect to the plurality of valve openings. The engine includes an engine brake having a brake housing mounted within the valve block and defining, at least in part, a hydraulic circuit and a follower piston chamber and a brake piston chamber in communication with the hydraulic circuit. A follower piston is disposed in the follower piston chamber, and a brake piston is disposed in the brake piston chamber. The follower piston is configured to move between an extended position in which follower piston follows the at least one brake cam lobe and a retracted position in which the follower piston does not follow the rotating brake cam lobe. The brake piston is in pressure responsive relation with the follower piston to move. A brake rod is coupled to the brake piston and configured to engage an associated one of the plurality of finger followers at least when the follower piston is in the extended position. When the follower piston is in the retracted position, the associated finger follower is configured to pivot about an associated one of the plurality of pivots as the associated finger follower follows an associated one of the valve cam lobes to effect lifting and seating of an associated one of the plurality of valves. When the follower piston is in the extended position, the brake rod engages the associated finger follower to lift the associated valve as the associated finger follower follows the associated valve cam lobe release compression from an associated one of the one or more engine cylinders.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
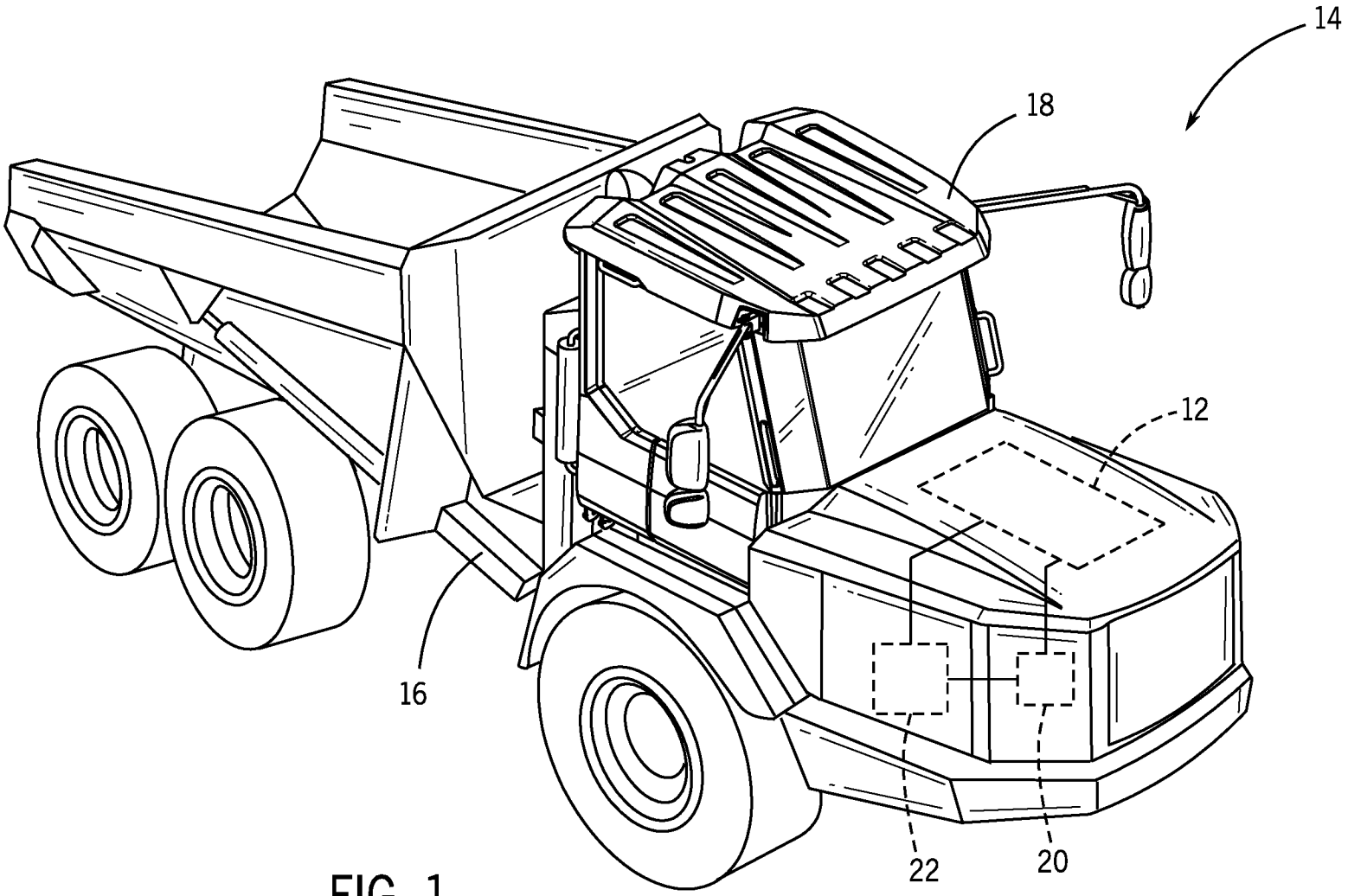
FIG. 1 is an isometric view of an example work vehicle in the form of a dump truck in which a Type II valvetrain and engine brake arrangement according to this disclosure may be incorporated.

The following describes one or more example embodiments of the disclosed Type II valvetrain and engine brake arrangement, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Furthermore, in detailing the disclosure, terms of direction and orientation, such as "longitudinal," "inner," "outer," "radial," "axial," "circumferential," "lateral," and "transverse" may be used. Such terms are defined, at least in part, with respect to a wheel axle, pivot axis, and/or a work vehicle. As used herein, the term "longitudinal" indicates an orientation along the length of the apparatus; the term "lateral" indicates an orientation along a width of the apparatus and orthogonal to the longitudinal orientation; and the term "transverse" indicates an orientation along the height of the apparatus and orthogonal to the longitudinal and lateral orientations. These orientations may be taken in relation to a work vehicle, or a travel direction of the work vehicle, to which the components may be attached. In other examples, the components referenced by those terms may be reversed in accordance with the present disclosure.

Overview

As discussed above, engine braking is a useful technique to slow vehicle motion, especially in large on-road and off-road work vehicles carrying heavy loads, using intrinsic components of the work vehicle to dissipate kinetic energy without resorting to, or to reduce reliance on, external braking components that may otherwise wear more quickly. Engine brakes of various types are known, including various hydraulically-actuated compression release engine brakes with hydraulic manifolds mounted within a valve block of the engine that serve to open a cylinder valve to decompress the cylinder and prevent a power stroke. Engine brakes of this type are commercially available from Jacobs Vehicle Systems, Inc. of Bloomfield, Conn. for various engine architectures.

Type II valvetrains, as noted above, include both a rocker shaft mounted varieties and end pivot varieties, the former being explained in the name and the latter being configurations in which a rocker or follower has a free end, opposite where the rocker or follower interacts with the valve it controls, that pivots on a pivot during operation of the engine. In various end pivot Type II engine architectures, the type contemplated herein, the pivot may be fixed or movable with respect to an engine crankcase, and in some cases, the pivot is provided by a lash adjuster component, such as a lash adjuster (e.g., a hydraulic lash adjuster (HLA)). In such cases, the lash adjuster may have a movable head or plunger that interacts with the free end of the rocker or follower to apply a lash adjustment force that acts on the valve through the rocker or follower to eliminate lash or clearance between the valvetrain components of the valve, and thereby may reduce or eliminate engine maladies such as valvetrain/noise-chatter and degraded engine performance.

This disclosure provides an engine and valvetrain and engine brake arrangement that provides compression release, hydraulically-actuated engine braking (CRHEB) in end pivot Type II (EPT2) valvetrain and engine architectures.

In various forms the engine brake may have a brake housing mounted within the valve block of the engine for routing the hydraulic fluid used to manage the engine braking. The brake housing provides a hydraulic circuit that couples to a hydraulic fluid source, which in some cases may be the engine oil driven by a dedicated engine oil pump and coupled to the brake housing through the engine crankcase. The brake housing may have one or more piston chambers that are fluidly coupled to the hydraulic circuit. In some cases, there are pairs of piston chambers that are coupled via a closed path of the hydraulic circuit in a pressure responsive manner (e.g., a master/slave arrangement) such that one piston drives another piston. For example, engine brake may include a (master) follower piston that reciprocates in one piston chamber of the brake housing in response to rotation of a dedicated or multi-purpose cam lobe (e.g., a brake cam lobe) as an associated camshaft rotates. The follower piston may be configured with a roller or a glide surface to ease wear at the interface of the follower piston with the cam lobe. Reciprocation of the follower piston may move the hydraulic fluid circuit to transmit pressure forces to reciprocate the (slave) brake piston in another brake chamber of the brake housing. The brake piston has a feature (e.g., a brake rod) to interface with the valvetrain and release compression from an associated engine cylinder.

In certain examples, the engine brake may work on a single cylinder or multiple cylinders and there may be a single engine brake housing or multiple engine brake housings mounted within the valve block. For example, a six cylinder engine, each cylinder may be braked using three brake housings, each braking a pair of cylinders. In such cases, the brake housings may be considered brake manifolds, which provide a common hydraulic circuit that serves two follower/brake piston pairs. Whether braking one or multiple cylinders, the engine braking function may be selectively controlled using one or more electric or electro-hydraulic solenoid valves to open or close the hydraulic passages within each brake housing to a vehicle hydraulic system (e.g., engine oil circuit), and thereby to control pressurization of the brake hydraulic circuit. One or more existing or engine brake dedicated controllers may control solenoid valve operation based on input from various vehicle sensors or the vehicle operator and memory-stored engine braking control algorithms.

The engine brake interacts with the valvetrain by direct physical engagement with one or more valve control components. In various implementations, the brake piston (via a brake rod) engages a rocker or follower component. For simplicity, the rocker or follower component will be referred to herein as a "finger follower." This term should be understood to include a rocker arm component that follows a cam lobe to lift and seat an associated cylinder valve and to exclude valve bridges that operate valve pairs. Moreover, since the engine brake described herein pertains to EPT2 valvetrains, the term "finger follower" as used herein will refer to a rocker arm that has a free end coupled to a fixed or movable pivot about which it pivots during normal engine operation. It should be understood that various finger follower constructions may be utilized with the disclosed valvetrain and engine brake arrangement of which the term is inclusive.

In certain examples, the valvetrain and engine brake arrangement may utilize a specialized hinged or fulcrum finger follower (FFF), such as detailed below. The FFF is a multi-part component part in which two or more follower sections are joined at a fulcrum intermediate the ends of the FFF to allow some degree of pivotal motion about a hinge axis extending through the fulcrum during engine braking. The follower sections are configured to act as a single piece or lever arm during normal engine operation in which the follower sections pivot about the pivot from the pivot end as the cam lobe rotates. Then during engine braking, the brake piston may engage the follower section at the valve end of the FFF to lift the valve (i.e., valve opened for compression release). The two follower sections pivot about the hinge axis at the fulcrum, thereby reacting a constant force on the end pivot which allows for lash adjustment with conventional lash adjusters.

In other implementations, the valvetrain and engine brake arrangement may utilize a conventional roller finger follower (RFF) that pivots on a pivot at one end and couples to the valve rod at the other end. A roller mounted between the ends follows an overhead cam lobe that is ramped or eccentric to effect pivoting of the roller finger follower, and thereby lifting and seating of the valve, during normal engine operation. During engine braking, the brake piston engages the valve end of the RFF between the valve tip and end pivot to lift the valve (i.e., valve opened for compression release). To accommodate rotation of the cam lobe during engine braking, the RFF will pivot to a position of disengagement from the primary cam lobe while being engaged with the braking cam lobe. The braking cam lobe will re-engage the RFF to the primary cam lobe after the braking valve motions are accomplished. By way of example, the movable pivot may be a lash adjuster with a reciprocating plunger. Use of the disclosed valvetrain and engine brake arrangement thus does not inhibit conventional lash adjustment during normal engine operation.

In still more refined implementations, the valvetrain and engine brake arrangement may utilize a switchable fulcrum roller finger follower (SRFFF), such as detailed below. The SRFFF is a multi-part component part that provides cylinder deactivation (CDA) during such engine operation. The SRFFF has three or more follower sections, two joined and operating in the manner of the FFF described above. The third follower section couples to one of the other follower sections at a second hinged axis. The SRFFF includes a movable latch that can be selectively controlled (e.g., by hydraulic pressure acting on a piston) to latch or unlatch the third follower section. With the third follower section latched, the SRFFF is configured to act as a single piece or lever arm during normal engine operation in which the follower sections pivot about the pivot (which again may be a lash adjuster) from the pivot end as the cam lobe rotates. During engine braking, and with the third follower section latched, the brake piston may engage the follower section at the valve end of the SRFFF to lift the valve (i.e., open the valve for compression release). Then during CDA operation of the engine, the third follower section is unlatched to that it may pivot about the second hinge axis and absorb the cam motion continuously during CDA engine operation.

The valvetrain and engine brake arrangement described herein also allows for enhanced engine braking, sometimes referred to as 1.5 stroke braking, in that a second compression release event may be achieved after the initial compression release event, which may be at top dead center (TDC) of the compression stroke prior to what would normally be the power stroke of the cycle. The second compression release event may be achieved by using CDA to keep the exhaust valve closed during the normal positive power exhaust valve lift event. While the exhaust valve is disengaged from the normal positive power lift event, an additional compression release valve lift is provided by the engine braking system. This additional compression release event thus allows for additional energy to be dissipated through the engine, and with lower valve lift values, as compared to conventional engine braking.

Figure 2:
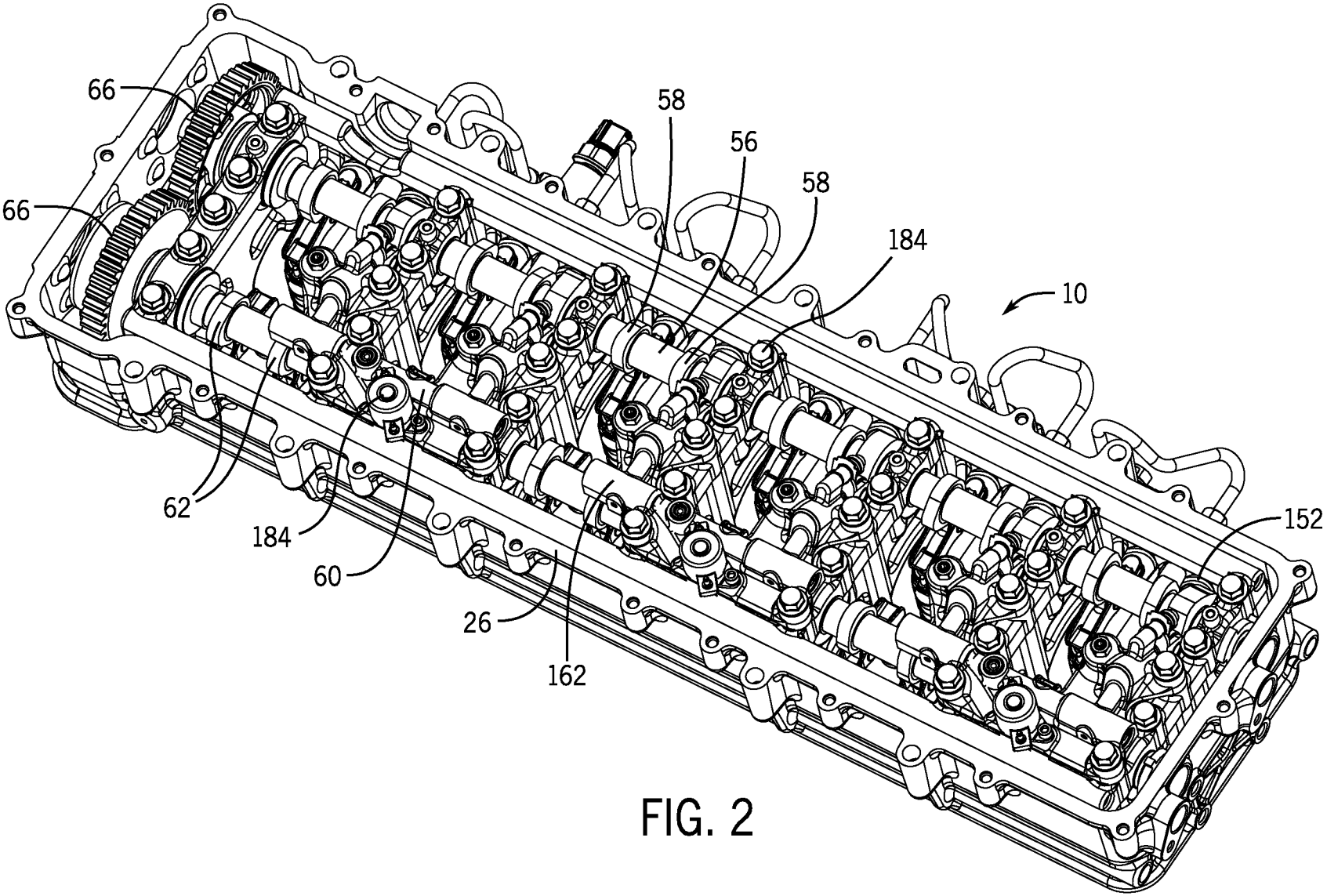
FIG. 2 is an isometric view of an example valve block having an example Type II valvetrain and engine brake arrangement.

Example Embodiment(s) of Type II Valvetrain and Hydraulic Engine Brake Arrangement Referring to FIGS. 1 and 2, the disclosed engine and valvetrain and engine brake arrangement is a Type II valvetrain and engine brake arrangement 10 of an internal combustion engine (ICE) 12, such as a diesel engine, of a large on-road and off-road work vehicle 14. As shown, the work vehicle 14 may be considered to include a chassis 16 for carrying heavy loads, an operator cabin 18, a control system 20 and a hydraulic system 22 among other systems and components.

Generally, the ICE 12 supplies power to the work vehicle 14 either alone or as part of a hybrid power system in which power from the ICE 12 is supplemented or replaced during certain operational modes by one or more electric machines, fuel cells or other power sources. In the example implementations shown and described herein the ICE 12 is a four-stroke, inline, six-cylinder compression ignition engine with a Type II valvetrain, as detailed below. The ICE 12 may be controlled by an engine control module (not shown) of the control system 20. In addition to providing tractive power to propel the work vehicle 14, the ICE 12 may provide power to various onboard subsystems, including various electrical and hydraulic components of the work vehicle 14, and for off-boarding power to other sub-systems remote from the work vehicle 14. For example, the ICE 12 may provide mechanical power that is converted to an electric format to run the electronics of the control system 20 and one or more electric drives of the work vehicle 14. The ICE 12 may also provide mechanical power that is converted to hydraulic format to power various pumps and compressors that pressurize fluid to drive various actuators of the hydraulic system 22 in order to power wheel steering and various work implements onboard the work vehicle 14. The hydraulic system 22 may include other components (e.g., valves, flow lines, pistons/cylinders, seals/gaskets, and so on), such that control of various devices may be effected with, and based upon, hydraulic, mechanical, or other signals and movements.

The control system 20 may be configured as a computing device with associated processor devices and memory architectures, as a hard-wired computing circuit (or circuits), as a programmable circuit, as a hydraulic, electrical, or electro-hydraulic controller. The control system 20 may be configured to execute various computational and control functionality with respect to the work vehicle 14, including various devices associated with the ICE 12, the hydraulic system 22, and various additional components of the work vehicle 14. In some embodiments, the control system 20 may be configured to receive input signals in various formats (e.g., as hydraulic signals, voltage signals, current signals, and so on), and to output command signals in various formats (e.g., as hydraulic signals, voltage signals, current signals, mechanical movements, and so on).

Figure 3:
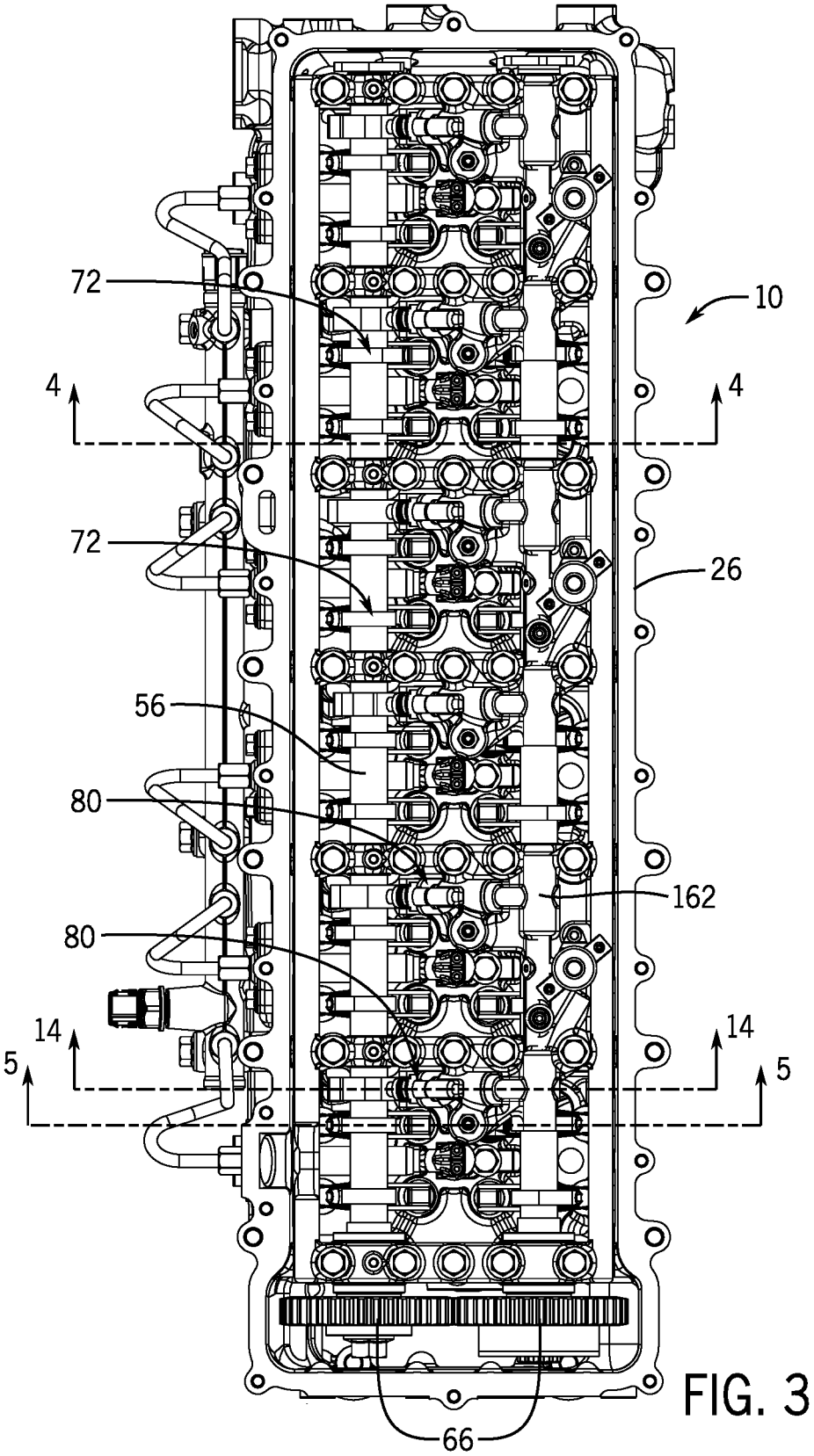
FIG. 3 is a top plan view thereof.
Figure 4:
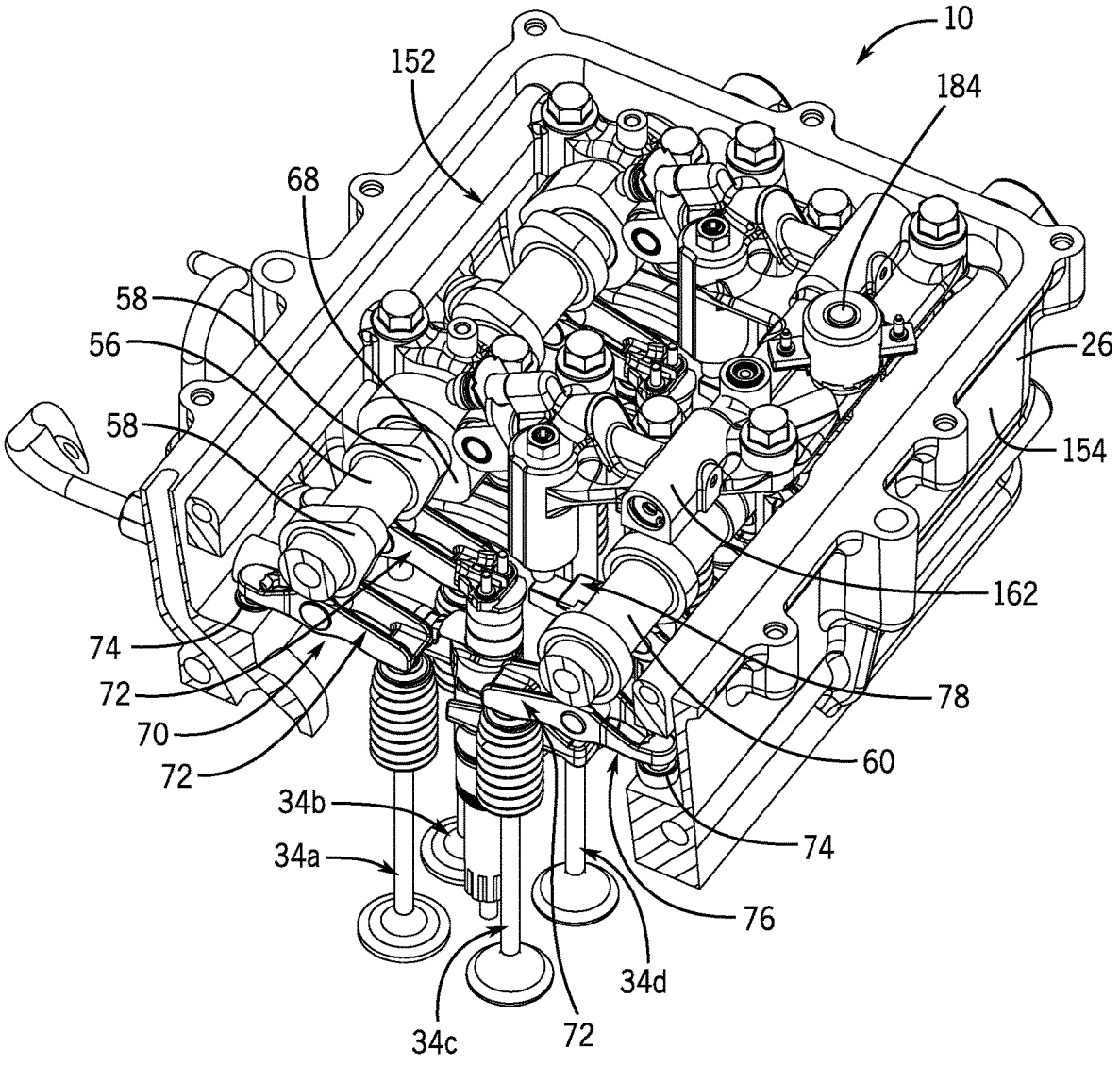
FIG. 4 is an isometric sectional view thereof taken along line 4-4 of FIG. 3.
Figure 5:
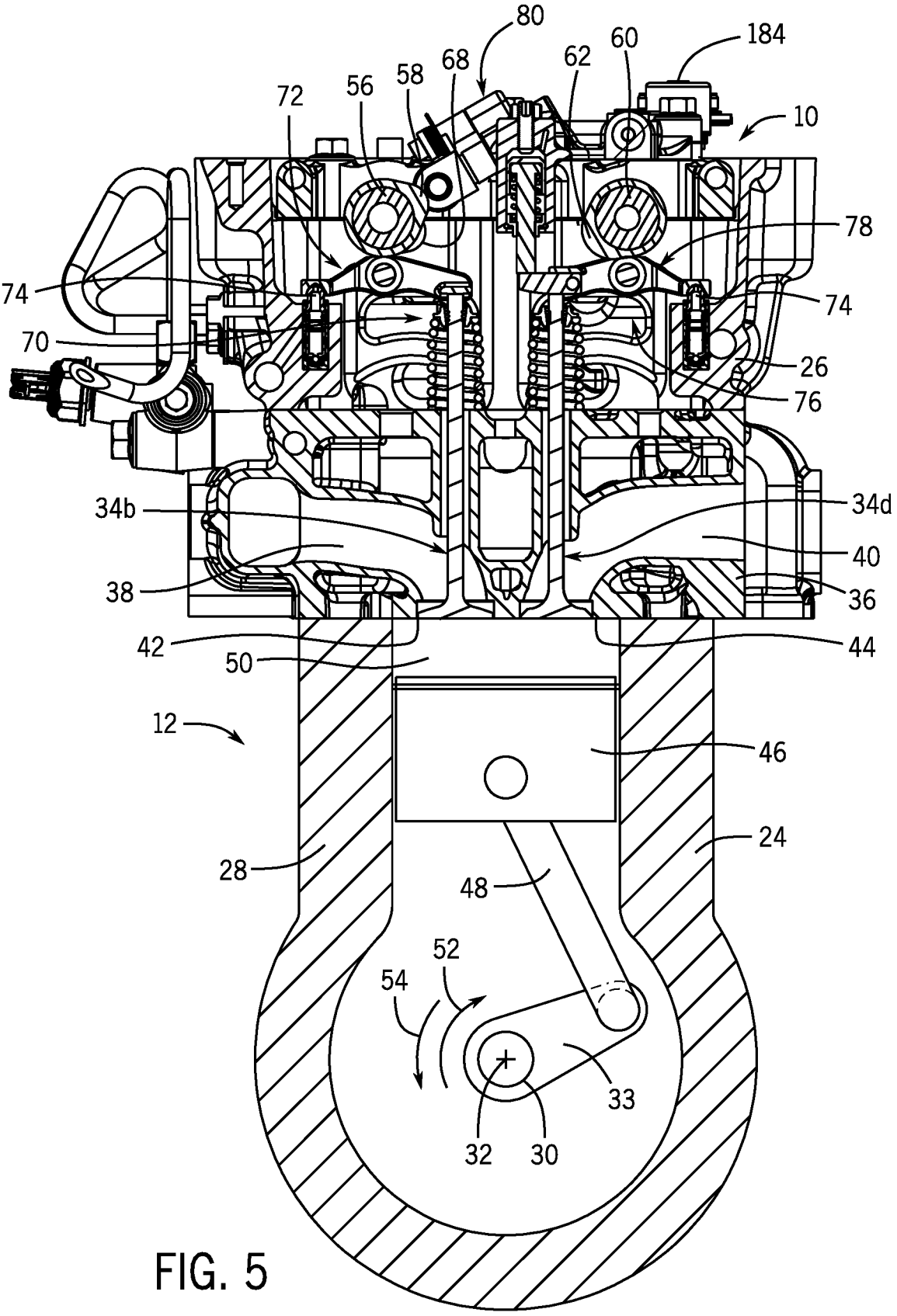
FIG. 5 is a sectional view along line 5-5 of FIG. 3 and showing schematically an engine crankcase with a piston-cylinder arrangement.

Referring also to FIGS. 3-5, the ICE 12 includes an engine crankcase 24, a valve block 26 mounted on the engine crankcase 24 to at least partially enclose one or more engine cylinders 28 defined by the engine crankcase 24, and a crank shaft 30 rotatably coupled to the engine crankcase 24 for rotation about a crank axis 32. The Type II valvetrain and engine brake arrangement 10 is configured to selectively open and close a pair of intake cylinder valves 34*a*, 34*b* in communication with each engine cylinder 28 and a pair of exhaust cylinder valves 34*c*, 34*d* in communication with each engine cylinder 28.

As shown in FIG. 5, the valve block 26 includes a lower valve body 36 defining a pair of intake valve openings 38 (only one of which is shown) extending between and in fluid communication with an intake manifold (not shown) and each engine cylinder 28, and a pair of exhaust valve openings 40 (only one of which is shown) extending between and in fluid communication with an exhaust manifold (not shown) and each engine cylinder 28. Each intake valve opening 38 includes a seat 42 positioned adjacent the engine cylinder 28 and configured to interact with the corresponding intake cylinder valve 34*a*, 34*b*. Each exhaust valve opening 40 includes a seat 44 positioned adjacent the engine cylinder 28 and configured to interact with the corresponding exhaust cylinder valve 34*c*, 34*d*.

Each engine cylinder 28 also includes an engine piston 46 and a connecting rod 48 connecting the engine piston 46 to the crank shaft 30 via a crank arm 33. The engine piston 46 reciprocates within the engine cylinder 28 between a top dead center (TDC) positioned proximate the valve block 26 and a bottom dead center (BDC) position farthest away from the valve block 26 to reduce or enlarge a size of a combustion chamber 50 within the engine cylinder 28. The reciprocating motion of the engine piston 46 within the engine cylinder 28 rotates the crank shaft 30 and the crank arm 33 about the crank axis 32 in a first clock direction of rotation 52. In the illustrated implementation, the ICE 12 is a four-stroke design having a conventional intake stroke, compression stroke, expansion or power stroke, and exhaust stroke in succession. The ICE 12 is operable in a positive power condition in which the ICE 12 drives the crank shaft 30 in the first clock direction of rotation 52 (e.g., applies torque to the crank shaft 30 in the first clock direction of rotation 52), and a negative power condition, in which the ICE 12 resists the rotation of the crank shaft 30 and acts as a brake (e.g., applies torque to the crank shaft 30 in a second clock direction of rotation 54 opposite the first clock direction of rotation 52). The positive power condition of the ICE 12 generally corresponds with combustion cycle operation, while the negative power condition generally corresponds with compression release engine braking operation.

The Type II valvetrain and engine brake arrangement 10 includes an intake camshaft 56, having valve cam lobes 58, disposed above the intake cylinder valves 34*a*, 34*b* of each engine cylinder 28, and an exhaust camshaft 60, having valve cam lobes 62, disposed above the exhaust cylinder valves 34*c*, 34*d* of each engine cylinder 28. The camshafts 56, 60 extend between opposite walls of the valve block 26 and are coupled together by intermeshed gears 66. The Type II valvetrain and engine brake arrangement 10 further includes a brake cam lobe 68 for each engine cylinder 28. As shown, the brake cam lobe 68 is provided on the intake camshaft 56, however, the brake cam lobe 68 can be provided on the exhaust camshaft 60. Each camshaft 56, 60 may have a portion which is eccentric to form each cam lobe 58, 62, 68, or the cam lobes 58, 62, 68 may be formed by ramps on the camshaft 56, 60. As such, the term "cam lobe" as used herein encompasses any of various ramps, eccentric lobes and other cam surface profiles. The profiles, the clock or angular position about camshafts 56, 60, or both the profile and the clock position, of the valve cam lobes 58, the valve cam lobes 62 and the brake cam lobe 68 are different when viewed from the side such that the cam lobes 58, 62, 68 interact with their mating components, as described herein, at different times when the camshafts 56, 60 are rotated. The camshafts 56, 60 and the cam lobes 58, 62, 68 cooperate with valve actuators to seat and unseat the cylinder valves 34*a*-34*d*. The valve actuators may be referred to as some variation of "rocker arms" in the industry, and are referred to in the example described herein as "finger followers" due to the elongated construction and function to seat and unseat the valves by engagement with or "following" the cam lobes 58, 62 as they rotate.

The intake cylinder valves 34*a*, 34*b* and the intake camshaft 56 form part of an intake apparatus 70 configured to control the flow of gases between the engine cylinder 28 and the intake valve openings 38. The intake apparatus 70 further includes, for each engine cylinder 28, a pair of roller finger followers (RFF) 72, and a pivot 74 supported by the valve block 26 for each intake RFF 72. The exhaust cylinder valves 34*c*, 34*d* and the exhaust camshaft 60 form part of an exhaust/brake apparatus 76 configured to control the flow of gases between the engine cylinder 28 and the exhaust valve openings 40. The exhaust/brake apparatus 76 further includes, for each engine cylinder 28, a RFF 72, a pivot 74 supported by the valve block 26 for the exhaust RFF 72, a specialized hinged or fulcrum finger follower (FFF) 78, a pivot 74 supported by the valve block 26 for the exhaust FFF 78, and an engine brake assembly 80.

Each cylinder valve 34*a*, 34*b*, 34*c*, 34*d* includes an elongated valve stem 82 having an enlarged spring retainer 84 proximate an upper tip thereof and a valve head 86 at a lower end thereof. A spring 88 is positioned around the valve stem 82 that has an upper end engaged by the spring retainer 84. The tip of the valve stem 82 extends through the spring retainer 84. The valve heads 86 of the cylinder valves 34*a*, 34*b* are configured to seat against the seats 42 or be unseated (i.e., "lifted") from the seats 42. The valve heads 86 of the cylinder valves 34*c*, 34*d* are configured to seat against the seats 44 or be lifted from the seats 44.

Referring also to FIGS. 6-10, each RFF 72 has a substantially elongated follower section 90 having a first end 92 configured to interact with the pivot 74, and an opposite second end 94 configured to interact with the valve stem 82 of the intake cylinder valve 34*a*, 34*b* or with the exhaust cylinder valve 34*c*. A lower surface of the first end 92 of the follower section 90 defines a contact surface 96 sized to at least partially receive a portion of the pivot 74 therein. A lower surface of the second end 94 of the follower section 90 has a contact surface 98 which directly contacts the upper end of the valve stem 82 of the cylinder valve 34*a*, 34*b*, 34*c*. The interaction between the contact surface 96 and the pivot 74 causes the follower section 90 to pivot relative to the valve block 26 about a pivot axis 100 that passes through the pivot 74. The follower section 90 defines an opening 102 in which a roller 104 is rotationally mounted by a pin 106. The axis of rotation of the roller 104 is perpendicular to a longitudinal axis of the follower section 90 defined between the ends 92, 94. The outer surfaces of each roller 104 contact the respective portions of the camshafts 56, 60, which have the valve cam lobes 58, 62 and transmit force to pivot each follower section 90.

Figure 8:
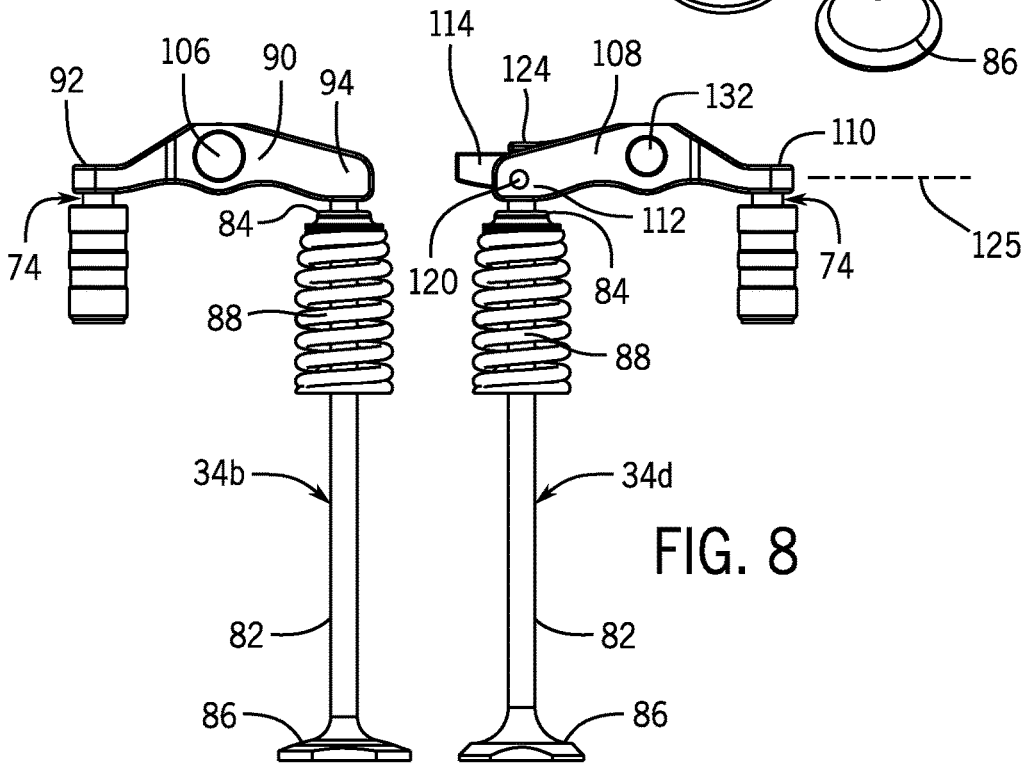
Figure 9:
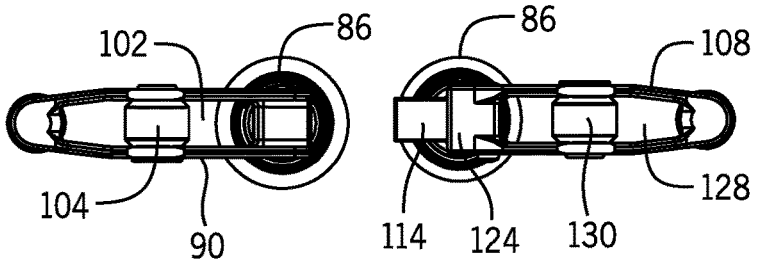
Figure 10:
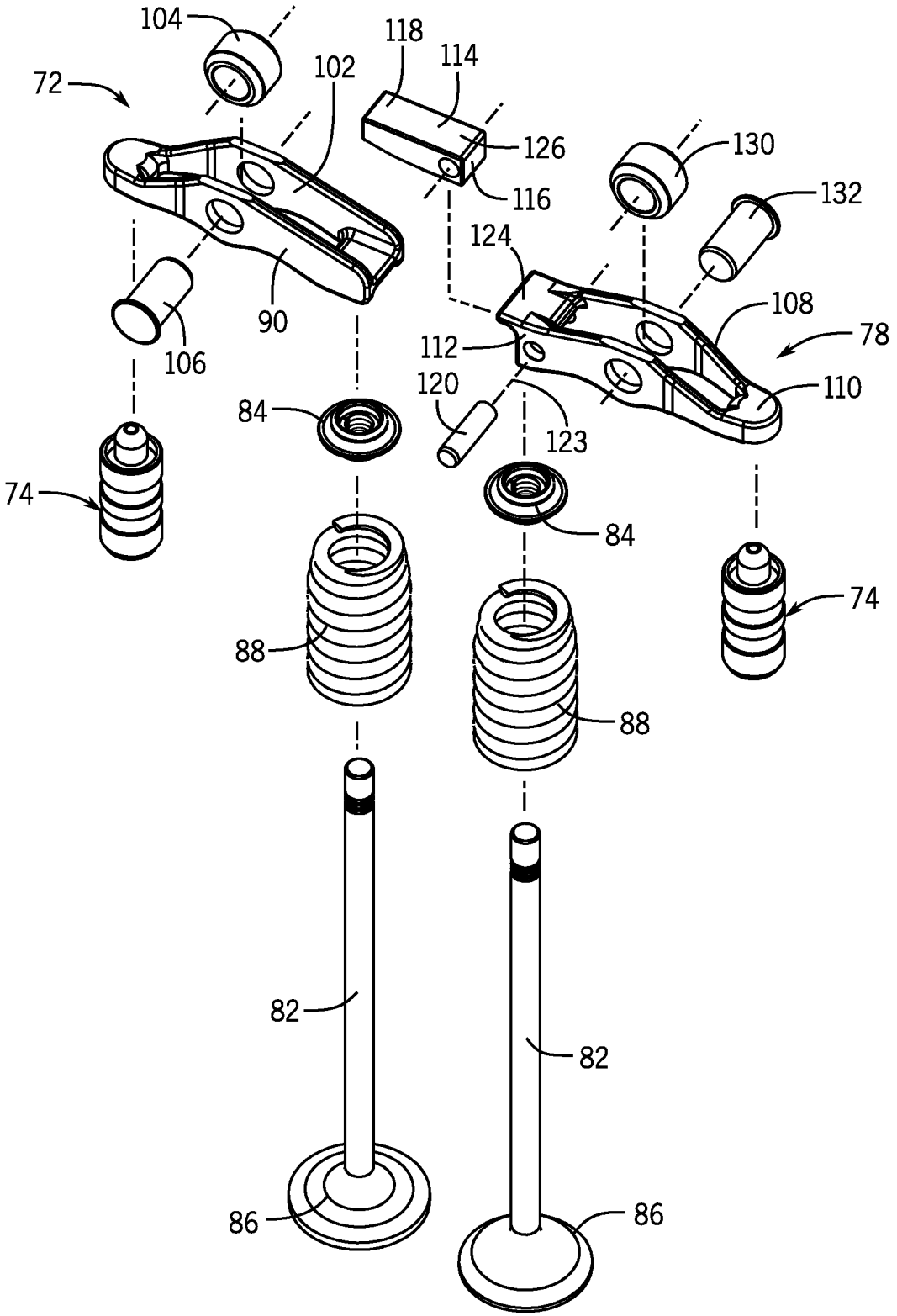

The FFF 78 has an elongated first follower section 108 having first and second opposite ends 110, 112, and an elongated second follower section 114 having first and second opposite ends 116, 118. The second end 112 of the first follower section 108 is pivotally coupled to the first end 116 of the second follower section 114 about a hinge or fulcrum axis 123 defined by a pin 120, which thereby serves as a fulcrum for the FFF 78. The fulcrum axis 123 is perpendicular to a longitudinal axis 125 of the first follower section 108 defined between the ends 110, 112. The first end 110 of the first follower section 108 defines a first end, the second end 112 of the first follower section 108 defines a first intermediate end, the first end 116 of the second follower section 114 defines a second intermediate end, and the second end 118 of the second follower section 114 defines a second end. A lower surface of the first end 110 of the first follower section 108 defines a contact surface 122 sized to at least partially receive a portion of the pivot 74 therein. The second end 112 of the first follower section 108 has a stop tab 124 extending longitudinally therefrom to the pin 120. The stop tab 124 overlaps a portion 126 of the upper surface of the second follower section 114 and is configured to engage the portion 126 to limit relative rotation of the first and second follower sections 108, 114 about the fulcrum axis 123 defined by the pin 120 in at least one clock direction. As shown in FIG. 8, relative rotation of the first and second follower sections 108, 114 is limited in the clockwise direction. The first follower section 108 defines an opening 128 in which a roller 130 is rotationally mounted by a rod 132. The axis of rotation of the roller 130 about the pin 120 is perpendicular to a longitudinal axis 125 of the first follower section 108 defined between the ends 110, 112. The outer surface of the roller 130 contacts the portion of the exhaust camshaft 60 that has the valve cam lobe 62 and transmits force to pivot the first follower section 108. A lower surface of the second follower section 114 has a contact surface proximate the first end 116 which directly contacts the upper end of the valve stem 82 of the cylinder valve 34*d*.

Figure 11:
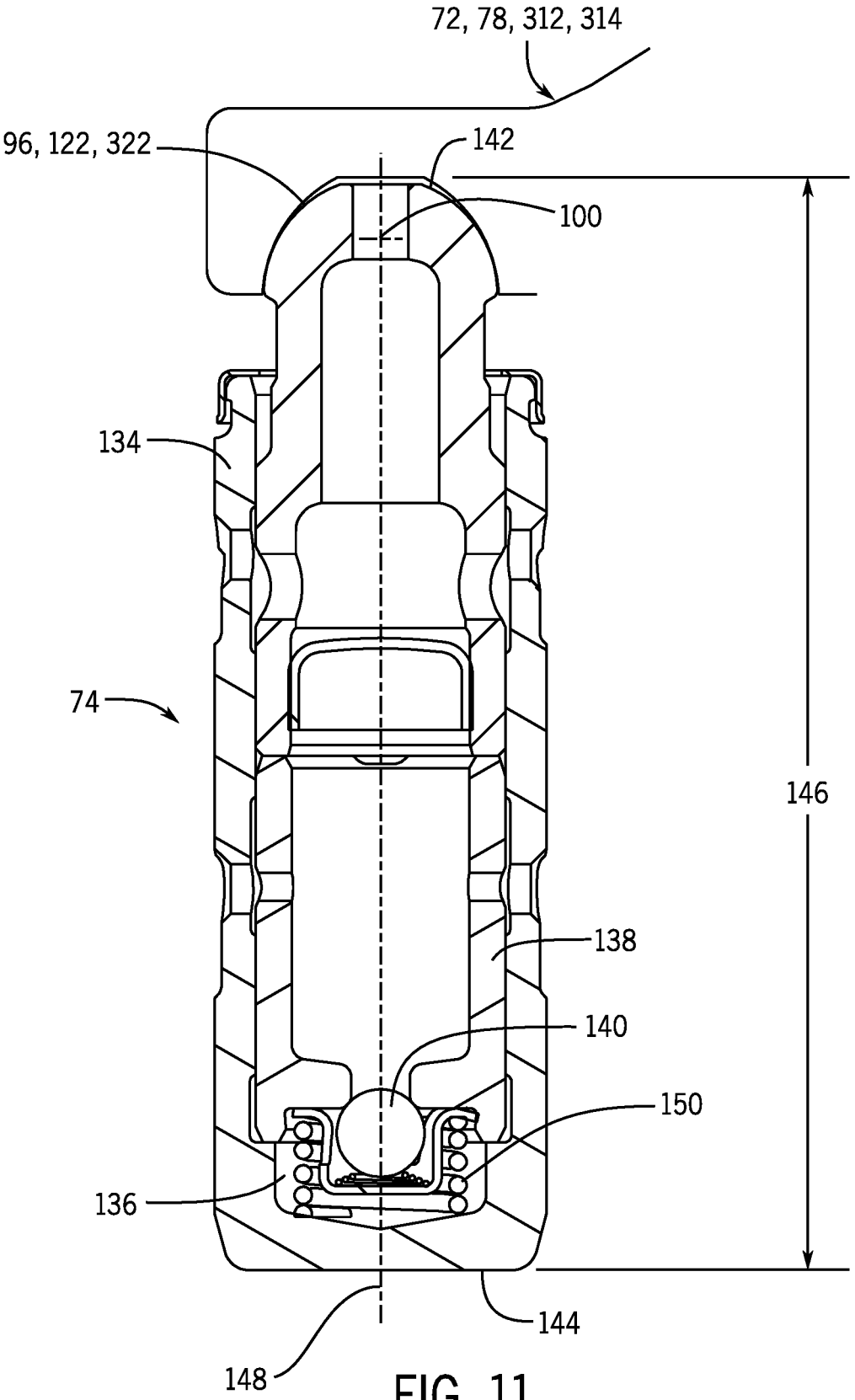
FIG. 11 is an enlarged sectional view of an example pivot used in the Type II valvetrain and engine brake arrangement.

In the illustrated example, the pivot 74 is defined by a lash adjuster, more specifically a hydraulic lash adjuster, which is fixed to the valve block 26 and has a movable component that allows the RFFs 72 and FFFs 78 to adjust, under hydraulic pressure control, the position for seating of the valve heads 86 (or "lash"). However, in alternative implementations, the pivot 74 may be fixed relative to the valve block 26 or mounted to other elements of the ICE 12. As detailed in FIG. 11, the pivot 74 (that is, in this case the example lash adjuster) includes a housing 134 at least partially defining a chamber 136 therein and fixed relative to the valve block 26, a plunger 138 at least partially positioned and movable within the chamber 136, and a check valve 140 to selectively control the flow of hydraulic fluid through the plunger 138 and into and out of the chamber 136. The plunger 138 defines a domed first end 142, the housing 134 defines a second end 144, and relative movement between the plunger 138 and the housing 134 causes the size of the chamber 136 and an adjuster length 146 defined between the ends 142, 144 along a lash adjuster axis 148 to change. More specifically, moving the plunger 138 away from the housing 134 causes the size of the chamber 136 to increase and the adjuster length 146 to increase, while moving the plunger 138 farther into the housing 134 causes the size of the chamber 136 to decrease and the adjuster length 146 to decrease. The check valve 140 is adjustable between an open position, in which a check ball is disengaged from its corresponding seat such that hydraulic fluid can enter and exit the chamber 136, and a closed position, in which the check ball is engaged with its corresponding seat and hydraulic fluid generally does not enter and exit the chamber 136. The check valve 140 also includes a biasing member 150 (e.g., a spring) configured to bias the check valve 140 into the closed position. When the check valve 140 is in the closed position, the plunger 138 is fixed relative to the housing 134 causing the adjuster length 146 to be effectively fixed. When the check valve 140 is in the open position, hydraulic fluid is able to enter and exit the chamber 136 and the plunger 138 is movable relative to the housing 134 causing the adjuster length 146 to be variable. While the illustrated pivot 74 includes a domed first end 142, the pivot 74 may have other configurations in alternative implementations.

Figure 6:
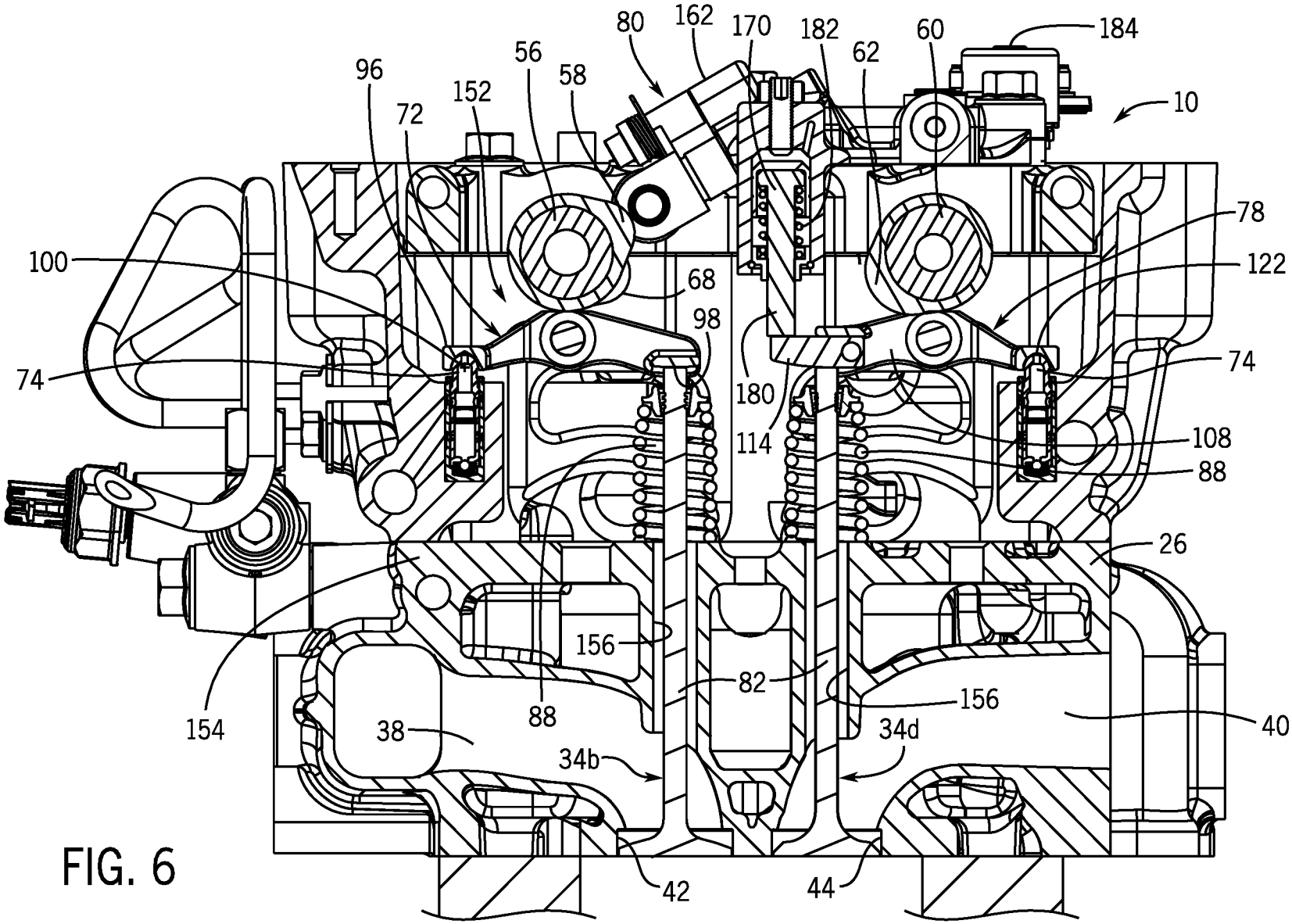
FIG. 6 is an enlarged partial sectional view of the valve block taken as shown in FIG. 5.
Figure 7:
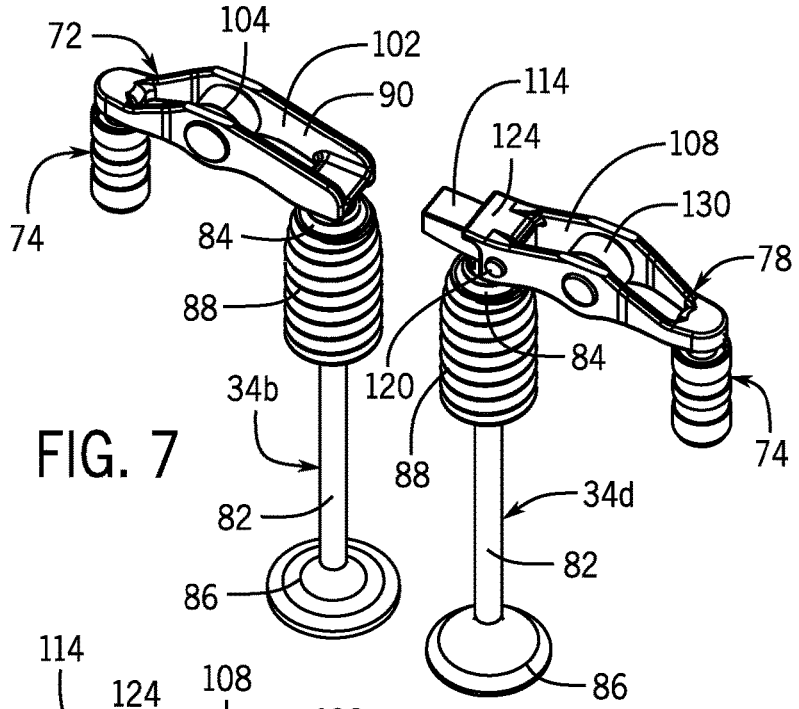
FIGS. 7-10 are various single-plane and isometric views of certain example valves and valve actuator components used in the Type II valvetrain and engine brake arrangement.

The RFFs 72 and the FFF 78 are positioned within a cavity 152, see FIG. 6, in the valve block 26 spaced above the openings 38, 40 and formed by a wall 154. The pivots 74 extend into the cavity 152. The valve stems 82 of the cylinder valves 34*a*, 34*b*, 34*c*, 34*d* extend through passageways 156 in the wall 154, and the valve heads 86 are within the cavity 152. The spring 88 of each cylinder valve 34*a*, 34*b*, 34*c*, 34*d* is positioned between an upper end of the wall 154 and the spring retainer 84. The valve heads 86 are positioned within the openings 38, 40 when seated in the seats 42, 44.

Figure 12:
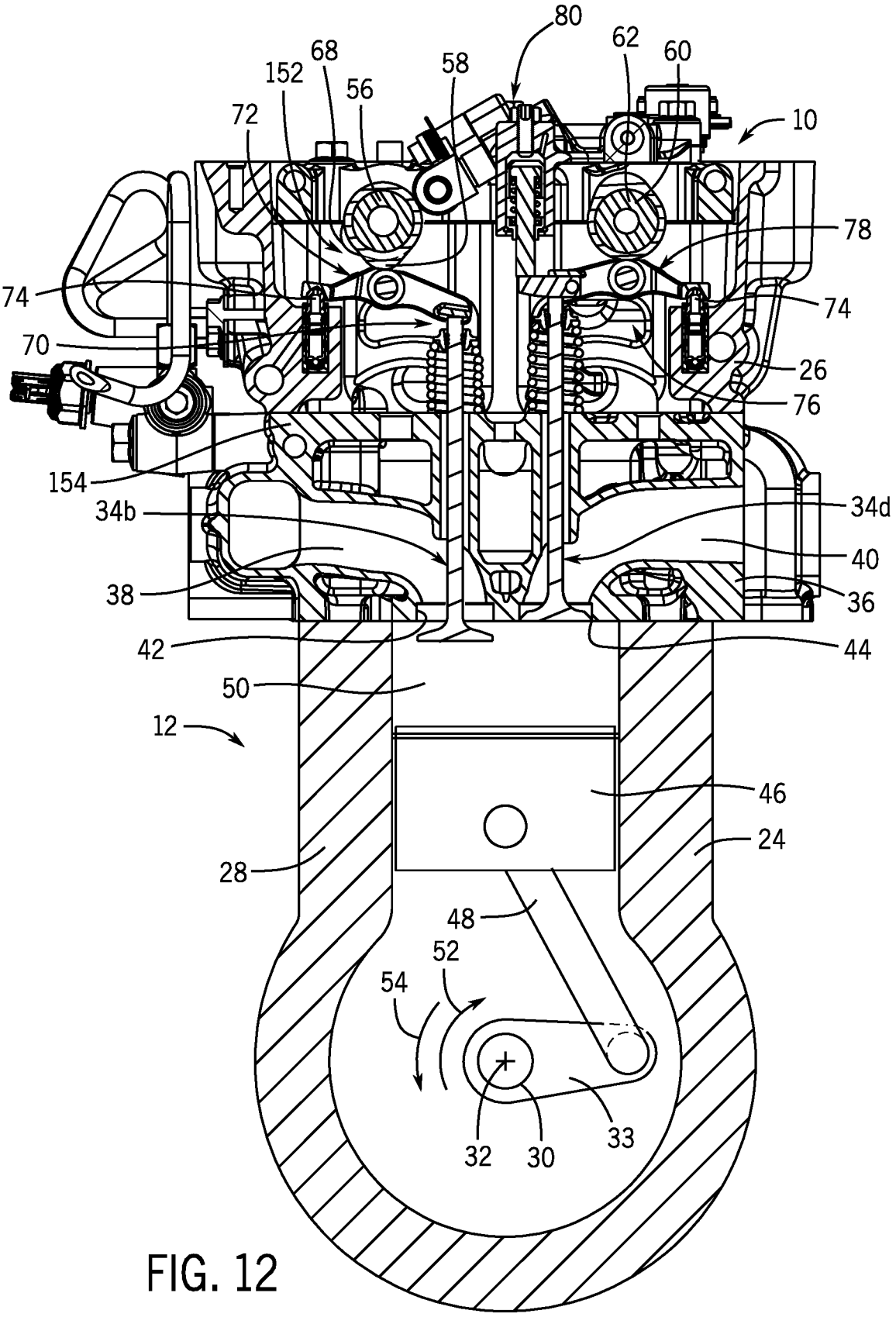
FIG. 12 is a sectional view similar to FIG. 4, but showing a different position of the piston-cylinder arrangement and an intake valve in a lifted position.
Figure 13:
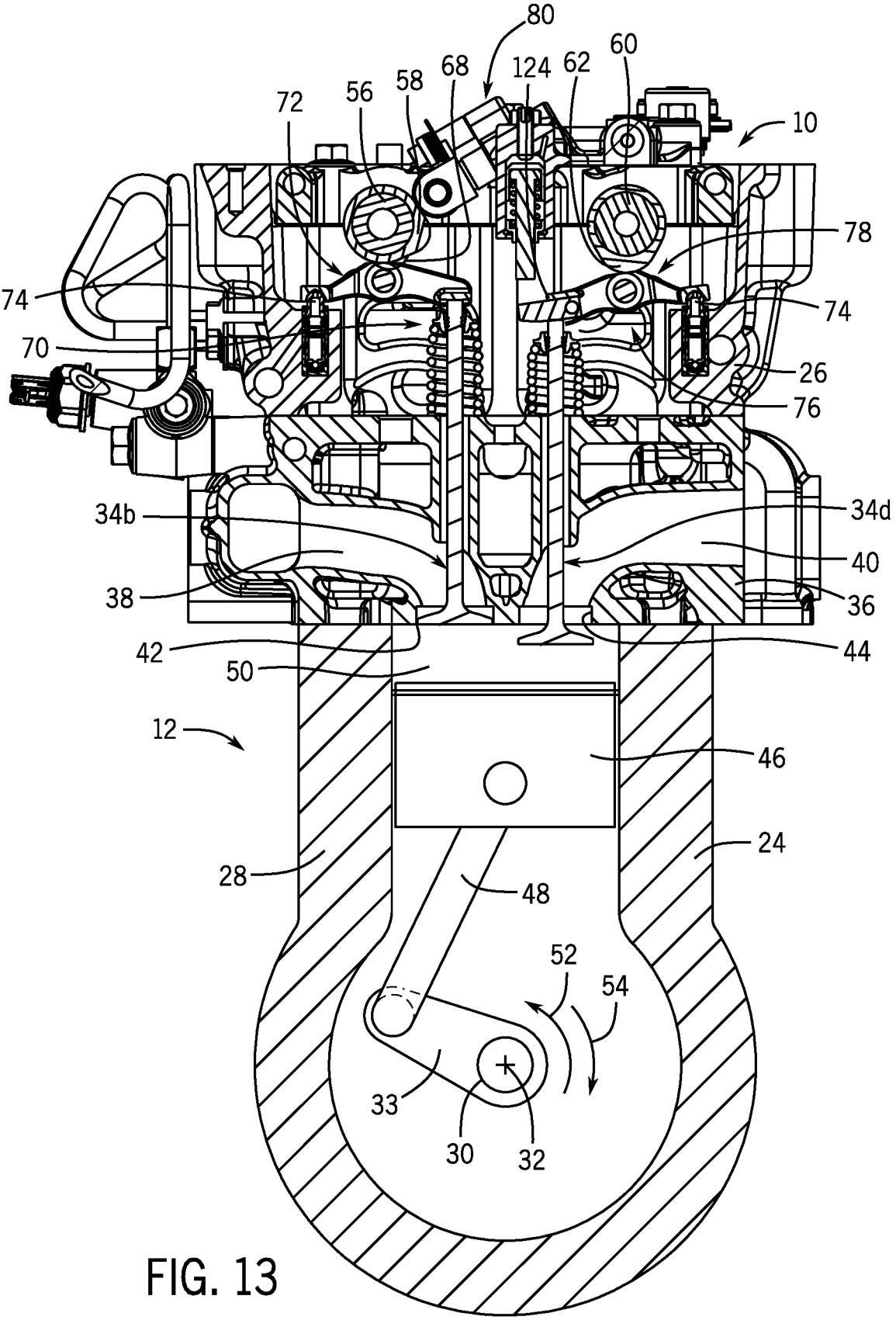
FIG. 13 is a similar sectional, but showing the piston-cylinder arrangement in another position and with an exhaust valve in a lifted position.
Figure 14:
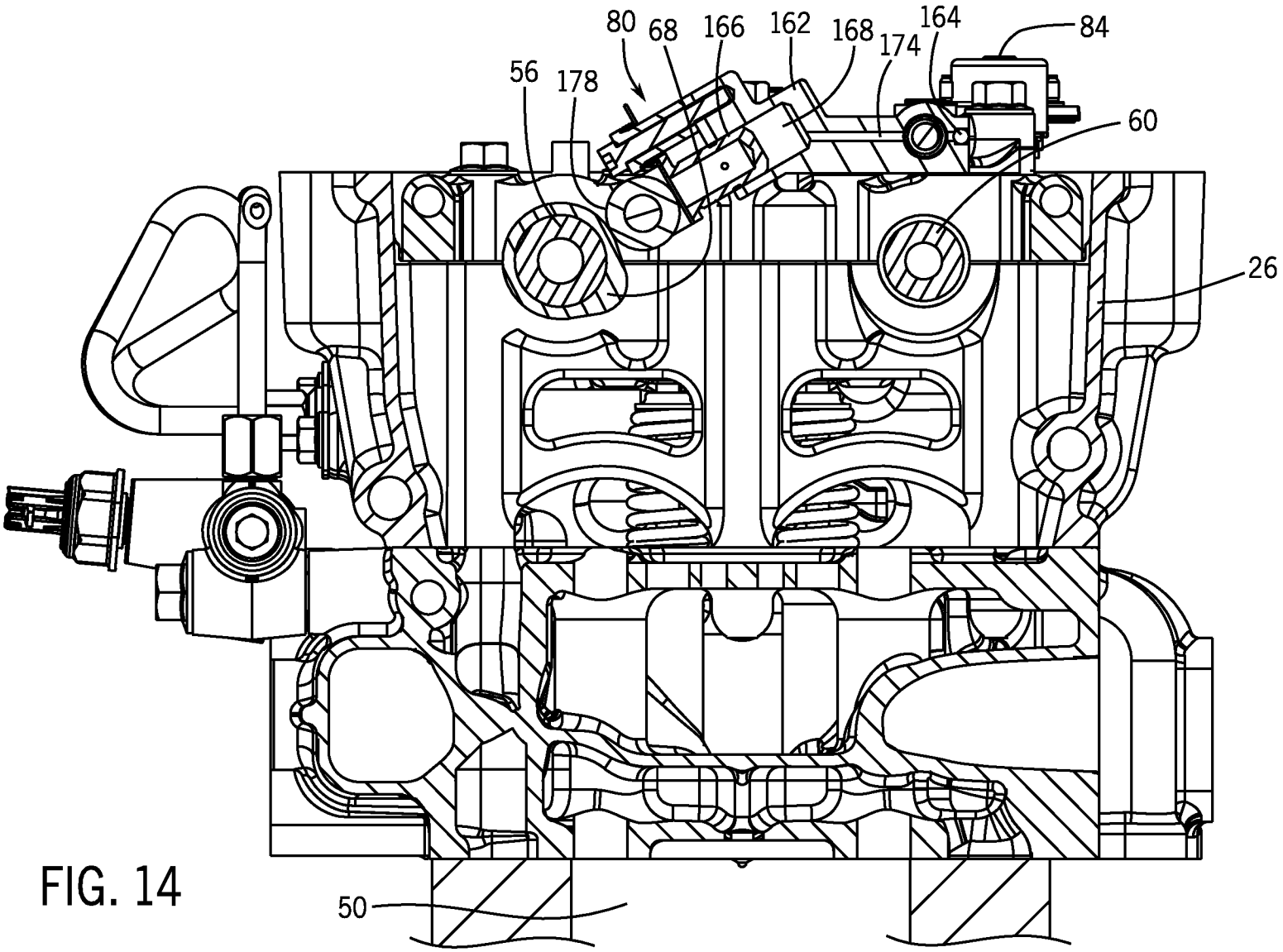
FIG. 14 is a partial sectional view along line 14-14 of FIG. 3.

In normal operation of the ICE 12, the adjuster length 146 is generally held fixed after any lash adjustment is made so that the RFFs 72 and the FFF 78 can pivot therearound. As the camshafts 56, 60 rotate, the valve cam lobes 58 engage with the rollers 104 on the intake RFFs 72, thereby causing the intake RFFs 72 to pivot about their pivots 74 and to lift the cylinder valves 34*a*, 34*b* from their seats 42, see FIG. 12. The valve cam lobes 62 on the exhaust RFF 72 and on the FFF 78 do not cause the RFF 72 and FFF 78 to pivot at this rotational position of the camshafts 56, 60 such that the cylinder valves 34*c*, 34*d* remain seated. During the intake stroke, the ICE 12 drives the crank shaft 30 in the first clock direction of rotation 52 (e.g., applies torque to the crank shaft 30 in the first clock direction of rotation 52), and the engine piston 46 is moved downward creating a partial vacuum that draws a fuel/air mixture (or air alone) through the intake valve openings 38 and into the combustion chamber 50. Once the camshafts 56, 60 rotate such that the valve cam lobes 58 no longer engage with the rollers 104 on the intake RFFs 72 sufficiently to effect pivoting, the springs 88 cause the cylinder valves 34*a*, 34*b* to move upward and reseat onto their seats 42, thereby causing the intake RFFs 72 to pivot about their pivots 74. The valve cam lobes 62 on the exhaust camshaft 60 do not engage with the exhaust RFF 72 and the FFF 78 to cause pivoting so the cylinder valves 34*c*, 34*d* remain seated, see FIG. 5. During the compression stroke, the fuel/air mixture (or air alone) is compressed to the top of the combustion chamber 50 by the engine piston 46 being moving upward by the ICE 12 driving the crank shaft 30 in the second clock direction of rotation 54 (e.g., applies torque to the crank shaft 30 in the second clock direction of rotation 54), reducing the volume of the combustion chamber 50. Towards the end of this movement, fuel is injected (if only air was present) and the fuel/air mixture is ignited, by a spark plug or by self-ignition. When the ignited air/fuel mixture expands, the engine piston 46 is pushed downwards, and this causes the expansion or power stroke that creates the ICE 12 power. The camshafts 56, 60 are in a rotated position such that the valve cam lobes 58, 62 are not in contact with the rollers 104, 130 so as to not pivot the RFFs 72 and the FFF 78 or lift the valves 34*a*-34*d* during the combustion stroke. During the exhaust stroke, the camshafts 56, 60 are rotated to the position where the exhaust valve cam lobes 62 engage with the rollers 104, 130 to pivot the exhaust RFF 72 and the FFF 78, about their pivots 74 and to lift the exhaust cylinder valves 34*c*, 34*d* from their seats 44, see FIG. 13. The stop tab 124 causes the first and second follower sections 108, 114 to move together in the same clock direction (in FIG. 6 this is the counterclockwise direction), such that the FFF 78 acts a single, unhinged lever during normal operation of the ICE 12. During the exhaust stroke, the engine piston 46 is moved upward, forcing the gases that were created during the expansion or power stroke out of the combustion chamber 50 through the exhaust valve openings 40. The camshafts 56, 60 continue to rotate and the exhaust valve cam lobes 62 no longer engage with the rollers 104, 130 so as to cause pivoting of the exhaust RFF 72 and the FFF 78. The springs 88 cause the cylinder valves 34*c*, 34*d* to move upward and reseat onto their seats 44, thereby causing the exhaust RFF 72 and the FFF 78 to pivot about their pivots 74. The four-stroke cycle then repeats continuously during normal engine operation.

The engine brake assembly 80 will now be described. In the example implementation of a six-cylinder engine, there are three engine brake assemblies 80 arranged within the valve block 26 above of the camshafts 56, 60, each serving two adjacent pairs of engine cylinders 28. As each engine brake assembly 80 has an identical configuration in the example implementations, only one engine brake assembly 80 will be detailed herein. Each engine brake assembly 80 may be selectively activated to brake all or a subset of the engine cylinders 28 (e.g., by electronic control of a solenoid valve 184, as discussed below). Specifically, each engine brake assembly 80 is activated to selectively cause at least one compression release event between or during parts of the compression stroke and the expansion or power stroke. As shown in FIGS. 2-4, 14 and 15, the engine brake assembly 80 includes the brake cam lobe 68, a brake housing 162 mounted within the valve block 26 which defines, at least in part, an internal hydraulic passage 164 coupled to a hydraulic fluid source (i.e., to an engine oil circuit pressurized by an engine oil pump, not shown, at least in part routed through internal passages of the valve block 26), a follower piston 166 provided in a follower piston chamber 168 defined by the brake housing 162, and a spring-loaded brake piston 170 disposed in a brake piston chamber 172 defined by the brake housing 162. The brake cam lobe 68 is rotationally offset from the valve cam lobes 58, 62. The follower piston chamber 168 is in communication with the hydraulic passage 164 by another hydraulic passage 174, and the brake piston chamber 172 is in communication with the follower piston chamber 168 by yet another hydraulic passage 176 within the brake housing 162.

The engine brake assembly 80 is activated by one or more solenoid valves 184 under control of the control system 20 to allow hydraulic fluid (e.g., engine oil) to flow into the brake housing 162. When the solenoid valve 184 is opened, a check valve (not shown) within the brake housing 162 seats so that hydraulic fluid flows into the hydraulic passages 164, 176 and creates a high-pressure, closed circuit between the follower piston chamber 168 and the brake piston chamber 172. One or more existing or engine brake dedicated controllers of the control system 20 may control the operation of the solenoid valve 184 based on input from various vehicle sensors or the vehicle operator and memory-stored engine braking control algorithms.

The follower piston 166 is movable within the follower piston chamber 168, and in response, the brake piston 170 is movable within the brake piston chamber 172. The follower piston 166 has a roller or a glide surface 178 on an end thereof which extends from the brake housing 162. The glide surface 178 is in contact with the portion of the camshaft 56 that has the brake cam lobe 68 thereon. The brake piston 170 has a brake rod 180 attached thereto which extends downward from the brake housing 162. The brake rod 180 is configured to be engaged with an upper surface of the second end 118 the second follower section 114 of the FFF 78 when in an activated position to cause relative pivoting between the first and second follower sections 108, 114 about the hinge defined by the pin 120 when the engine brake assembly 80 is activated. A spring 182 within the brake piston chamber 172 biases the brake piston 170 and brake rod 180 into a retracted, non-activated position. When the brake rod 180 is in the non-activated position, the spring 88 on the cylinder valve 34*d* pushes the second follower section 114 upward into contact with the stop tab 124, and there is no relative pivoting between the first and second follower sections 108, 114, such that, as noted above, the FFF 78 acts a single, unhinged lever during normal operation of the ICE 12 (i.e., without engine braking). When the brake piston 170 is in the non-activated position, the first follower section 108 transmits a lash adjustment force from the pivot 74 to the second follower section 114, which transmits the lash adjustment force to the exhaust cylinder valve 34*d*.

It is noted that each FFF 78 is configured and arranged so that the fulcrum axis 123 is located to extend perpendicularly from and spatially between the long-axis centerlines of the brake rod 180 and the contact region at which the valve cam lobe 62 engages the first follower section 108. Moreover, the fulcrum axis 123 is interposed between the long-axis centerline of the valve stem 82 of the exhaust valve cylinder valve 34*d* and the the contact region at which the valve cam lobe 62 engages the first follower section 108. This provides a suitable force and leverage balance for the FFF 78 to readily overcome the valve spring 88 force during normal engine operation and also for the brake rod 180 to readily overcome the valve spring 88 force during engine braking.

Figure 15:
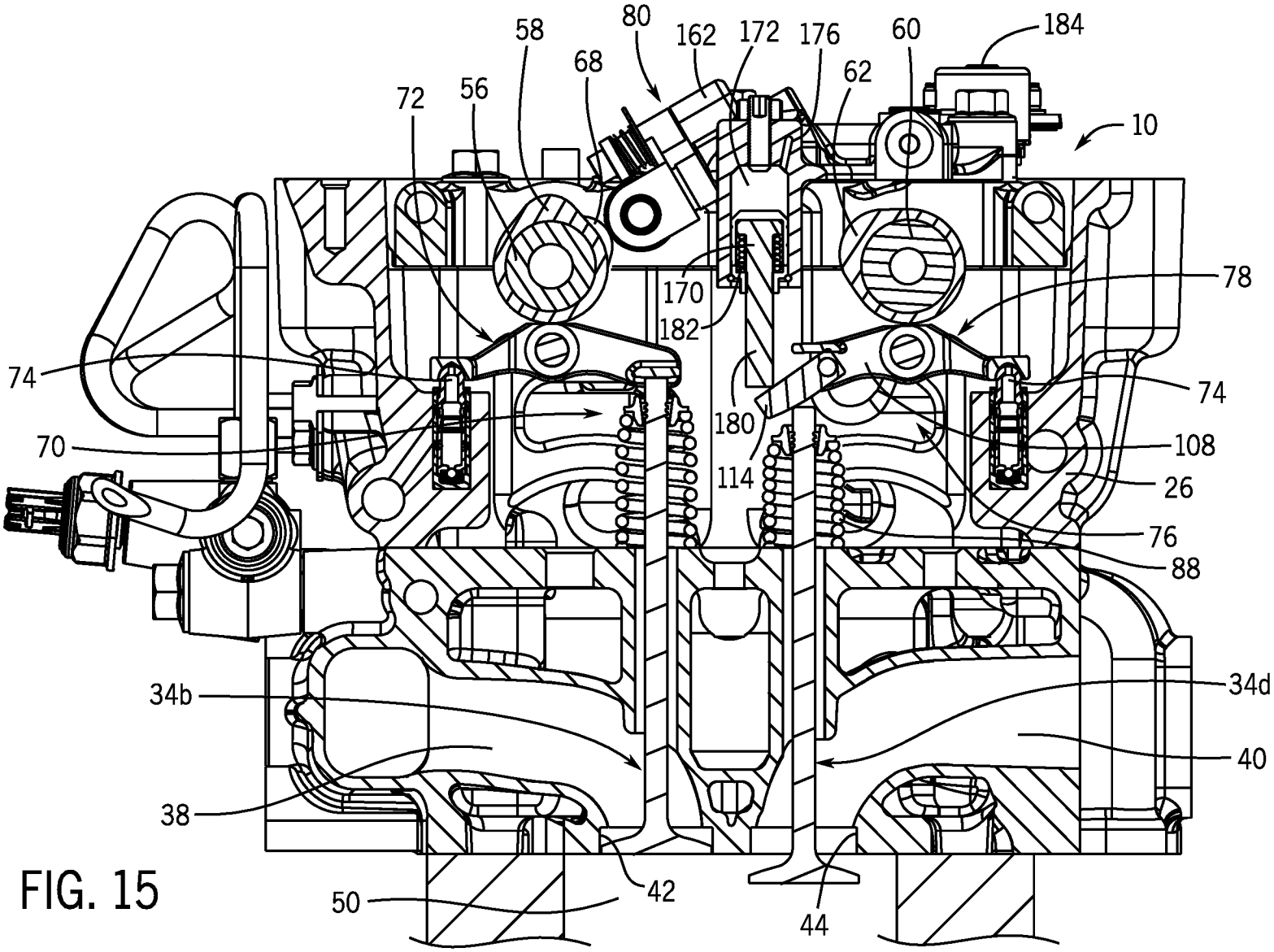
FIG. 15 is a sectional view similar to FIG. 5, but showing the exhaust valve in a lifted position.

At or near the compression stroke, or otherwise in between the compression stroke and the expansion stroke, the glide surface 178 on the follower piston 166 contacts the brake cam lobe 68, see FIG. 15, which causes the follower piston 166 to move within the brake housing 162 and effectively decrease the size of the follower piston chamber 168. This forces the hydraulic fluid out of the follower piston chamber 168, through the hydraulic line 164, through the hydraulic passage 176 and into the brake piston chamber 172. The spring 182 compresses and the size of the brake piston chamber 172 thereby effectively increases, which drives the brake rod 180 downwardly into the activated position and into engagement with the upper surface of the second end 118 of the second follower section 114. The first and second follower sections 108, 114 pivot relative to each other about the fulcrum axis 123 defined by pin 120, shown as counterclockwise in FIG. 6. The second follower section 114 pivots downward which causes the force of the spring 88 of the cylinder valve 34*d* to be overcome and the cylinder valve 34*d* lifts off of its seat 44, thereby effecting a decompression or compression release event by exhausting gases out of the combustion chamber 50 before power can be extracted in the expansion stroke. When the brake cam lobe 68 rotates so as not to force away the glide surface 178, the spring 88 of the cylinder valve 34*d* resumes its natural expanded condition and causes the second follower section 114 to pivot upward into engagement with the stop tab 124. The spring 182 expands within the brake piston chamber 172 and moves the brake rod 180 and brake piston 170 upwardly, thereby moving the brake rod 180 to the non-activated position. Hydraulic fluid flows out of the brake piston chamber 172, through the hydraulic passage 176, through the hydraulic passage 164, and back into the follower piston chamber 168. The follower piston chamber 168 effectively increases in size and the follower piston 166 and the glide surface 178 move away from the brake housing 162. This process repeats as the camshafts 56, 60 rotate.

Figure 16:
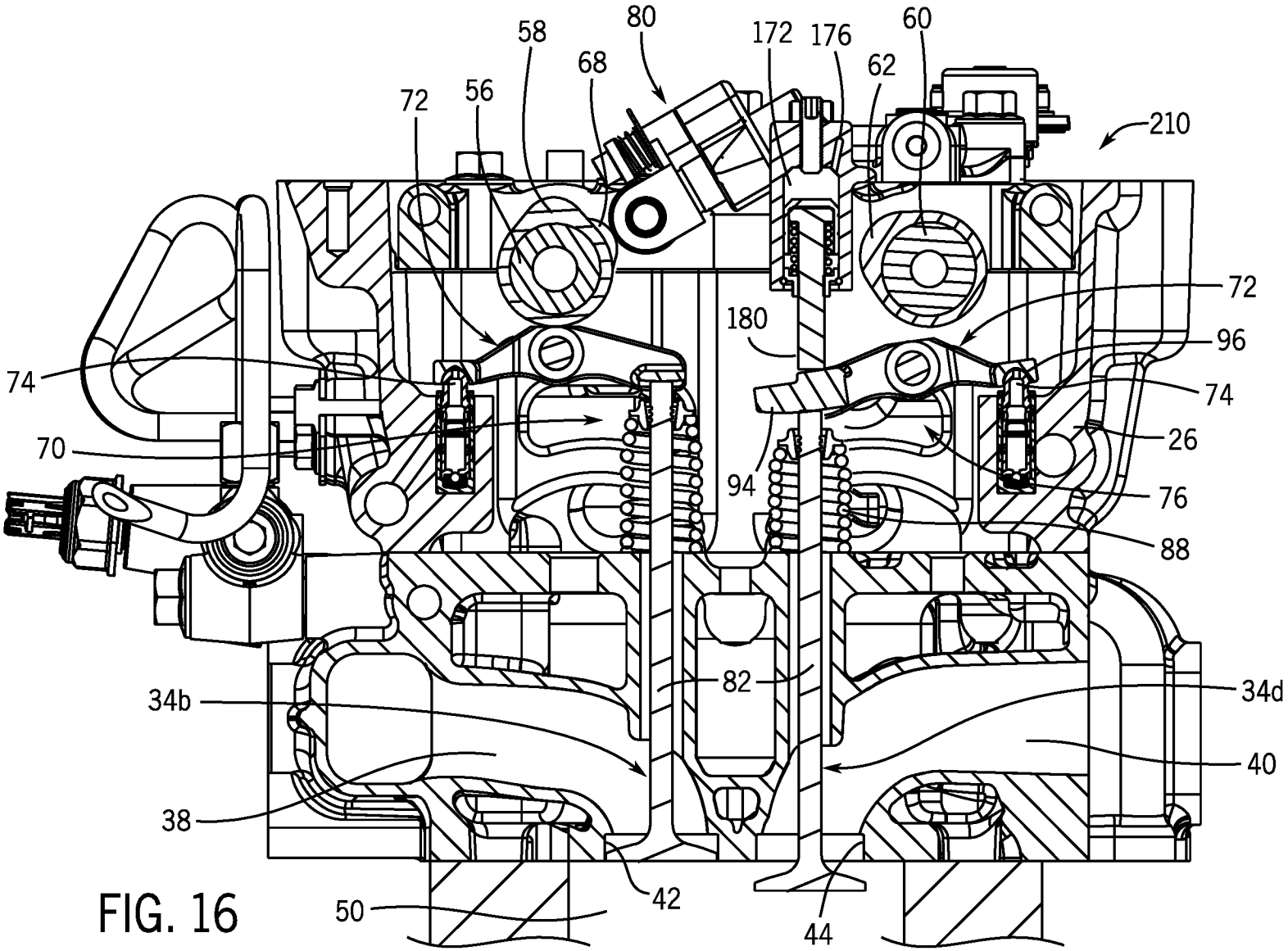
FIG. 16 is a sectional view similar to FIG. 15 of another embodiment of the Type II valvetrain and engine brake arrangement.
Figure 17:
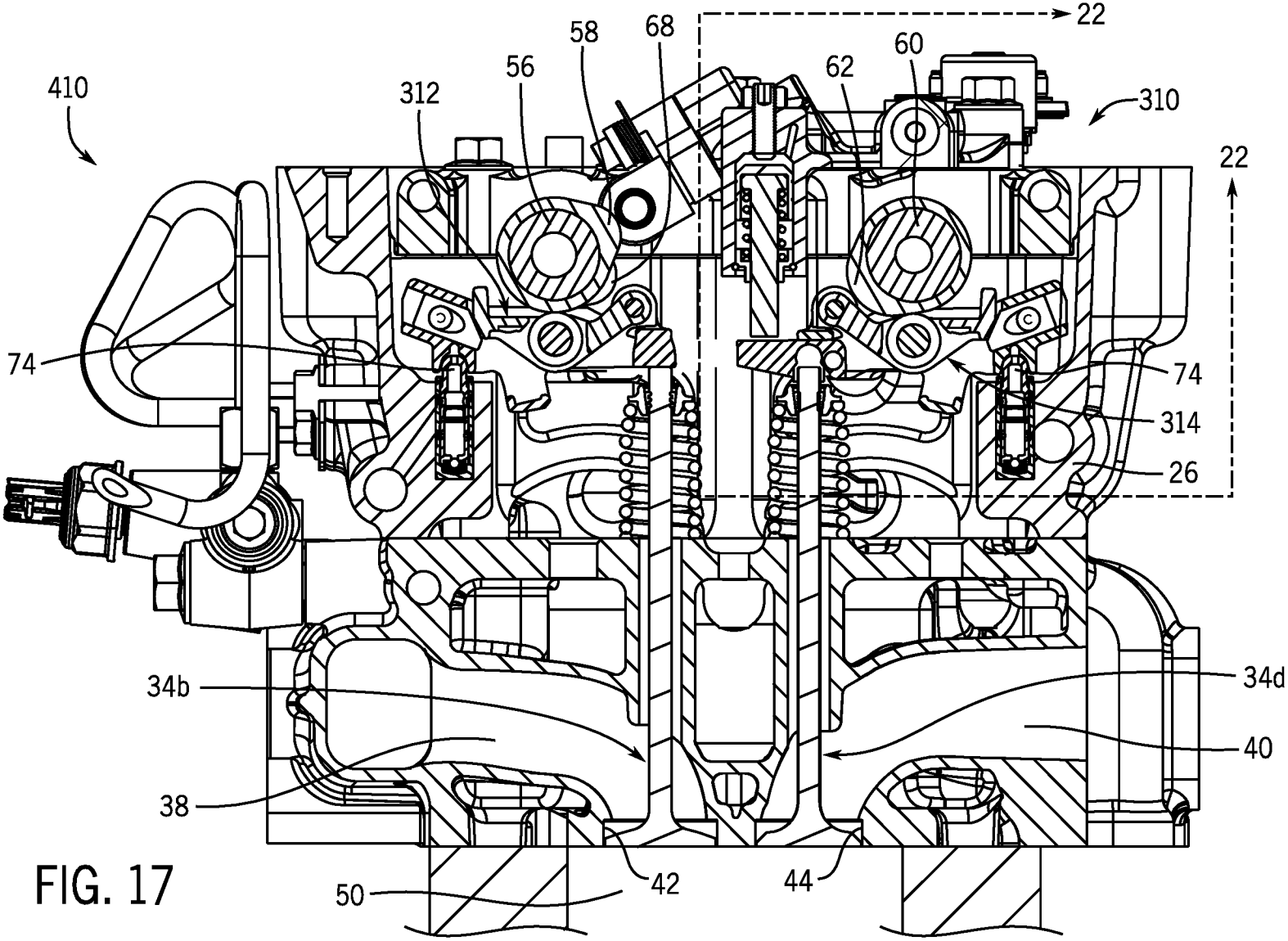
FIG. 17 is a sectional view similar to FIG. 15 of yet another embodiment of the Type II valvetrain and engine brake arrangement.
Figure 18:
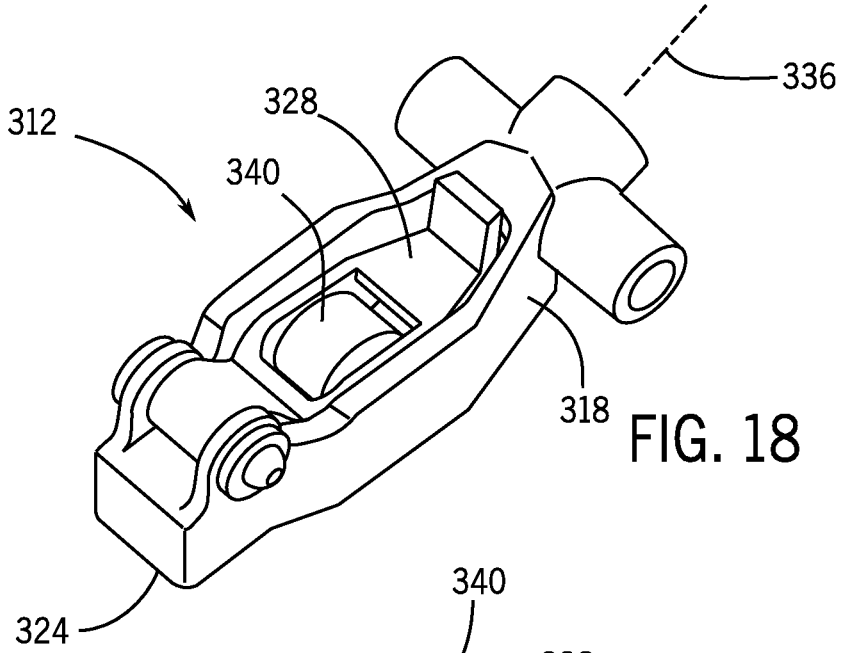
FIGS. 18 and 19 are isometric views of an example switchable valve actuator component used in certain examples of the Type II valvetrain.
Figure 19:
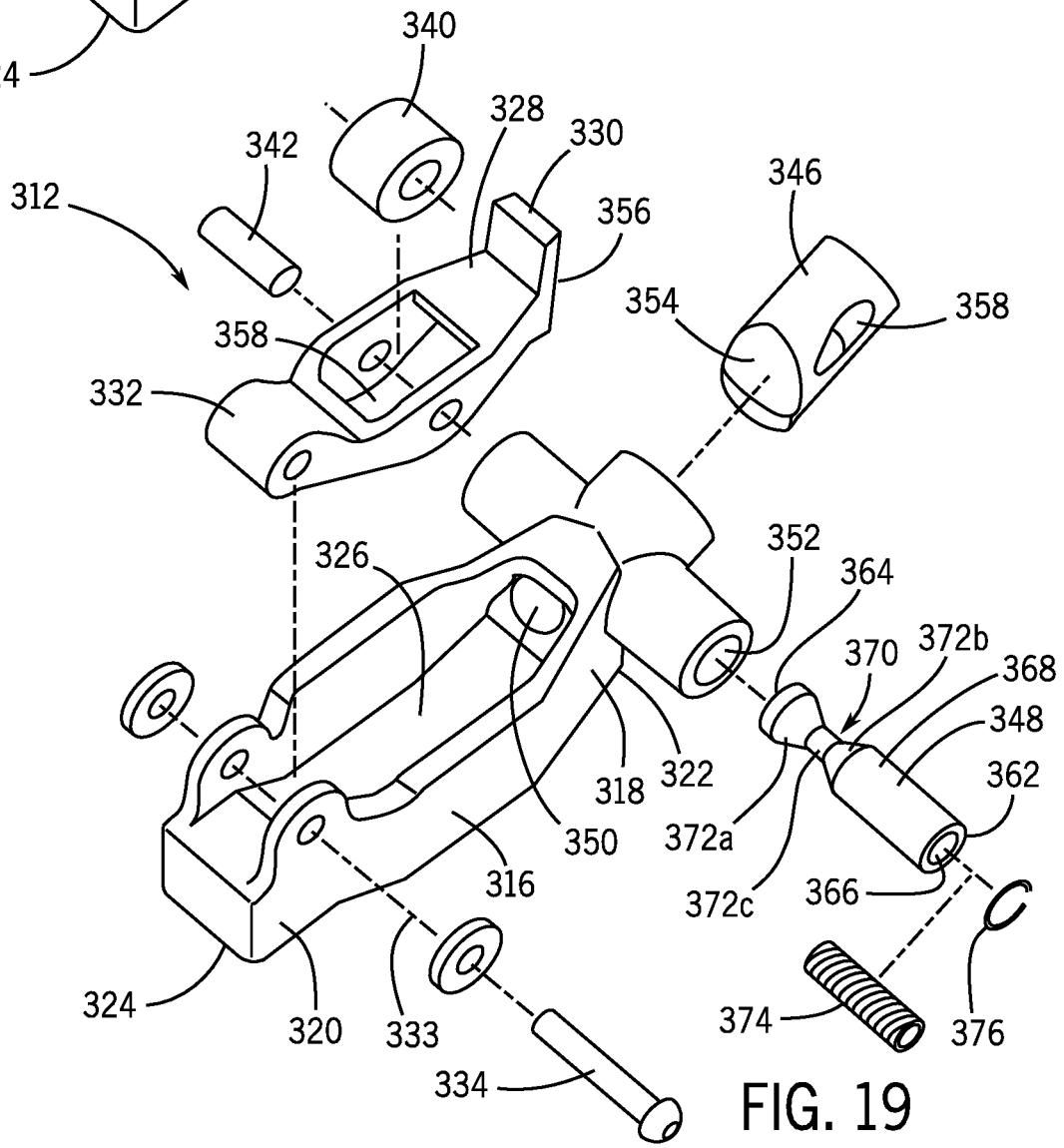

FIG. 16 illustrates another embodiment of the Type II valvetrain and engine brake arrangement 210 in which the FFF 78 in the preceding example implementation is replaced with an RFF 72 such that only RFFs 72 are utilized. Here again, the first end 92 of the exhaust RFF 72 is configured to interact with the pivot 74, and the second end 94 is configured to interact with the valve stem 82 of the exhaust cylinder valve 34*d* and with the brake rod 180. The interaction between the contact surface 96 and the pivot 74 causes the follower section 90 to pivot relative to the valve block 26 about the pivot axis 100. The outer surface of the roller 104 contacts the portion of the camshaft 60 that has the valve cam lobe 62 and transmits force to pivot the follower section 90. At or near the end of the compression stroke, the glide surface 178 on the follower piston 166 contacts the brake cam lobe 68 sufficiently to cause the follower piston 166 to move within the brake housing 162 and effectively decrease the size of the follower piston chamber 168. This forces the hydraulic fluid out of the follower piston chamber 168, through the hydraulic passage 164, through the hydraulic passage 176 and into the brake piston chamber 172, thereby driving the brake rod 180 downwardly into the activated position and into engagement with the upper surface of the second end 94 of the exhaust RFF 72. The second end 94 of the exhaust RFF 72 pivots downward which causes the force of the spring 88 of the cylinder valve 34*d* to be overcome and the cylinder valve 34*d* lifts off of its seat 44, thereby effecting a decompression event by exhausting gases out of the combustion chamber 50. When the brake cam lobe 68 rotates sufficiently away from the glide surface 178, the spring 88 of the cylinder valve 34*d* resumes its natural expanded condition and causes the exhaust RFF 72 to pivot upward about its pivot 74, and moves the brake rod 180 and brake piston 170 upwardly. This moves the brake rod 180 to the non-activated position causing the hydraulic fluid to flow out of the brake piston chamber 172, through the hydraulic passage 176, through the hydraulic passage 164, back into the follower piston chamber 168, and the follower piston 166 and the glide surface 178 move away from the brake housing 162. To accommodate the pivoting of the exhaust RFF 72 during engine braking, the exhaust RFF 72 will pivot to a position of complete disengagement from the camshaft 60 and valve cam lobe 62 under action of the brake rod 180. The braking cam lobe 62 will re-engage the exhaust RFF 72 to the primary cam lobe after the braking valve motions are accomplished. The centerline of the valve stem 82 of the valve 32*d* is between the centerline of the brake rod 180 acting on the exhaust RFF 72 and the contact region at which the valve cam lobe 62 engages the first follower section 108.

FIGS. 17-25 illustrate an example implementation of the Type II valvetrain and engine brake arrangement 310 with braking and cylinder deactivation (CDA) in which the RFFs 72 of the Type II valvetrain and engine brake arrangement 10 are replaced by switchable roller finger followers (SRFF) 312 and the FFFs 78 are replaced by switchable fulcrum roller finger followers (SRFFF) 314. Each SRFF 312 has a substantially elongated follower section 316 having a first end 318 configured to interact with the pivot 74, and an opposite second end 320 configured to interact with the valve stem 82 of the exhaust cylinder valve 34*d*. A lower surface of the first end 318 of the follower section 316 defines a contact surface 322 sized to at least partially receive a portion of the pivot 74 therein. A lower surface of the second end 320 of the follower section 316 has a contact surface 324 which directly contacts the upper end of the valve stem 82 of the cylinder valve 34*d*. The interaction between the contact surface 322 and the pivot 74 causes the follower section 316 to pivot relative to the valve block 26 about the pivot axis 100 that passes through the pivot 74. The follower section 316 defines an opening 326 in which a pivotable follower section 328 is mounted. The opening 326 has a first end proximate the first end 318 of the follower section 316 and a second end proximate the second end 320 of the follower section 316. The follower section 328 is substantially elongated and has a first end 330 that is configured to be proximate the first end of the opening 326, and an opposite second end 332 which is pivotally coupled to the second end 320 of the follower section 316 about a hinge axis 333 defined by a pin 334. The hinge axis 333 defined by the pin 334 is perpendicular to a longitudinal axis 336 of the follower section 316 defined between the ends 318, 320. The follower section 328 defines an opening 338 in which a roller 340 is rotationally mounted by a pin 342, which is perpendicular to the longitudinal axis 336. The outer surface of the roller 340 contacts the portion of the camshaft 56 or 60 which has the valve cam lobe 58 or 62.

Figure 22:
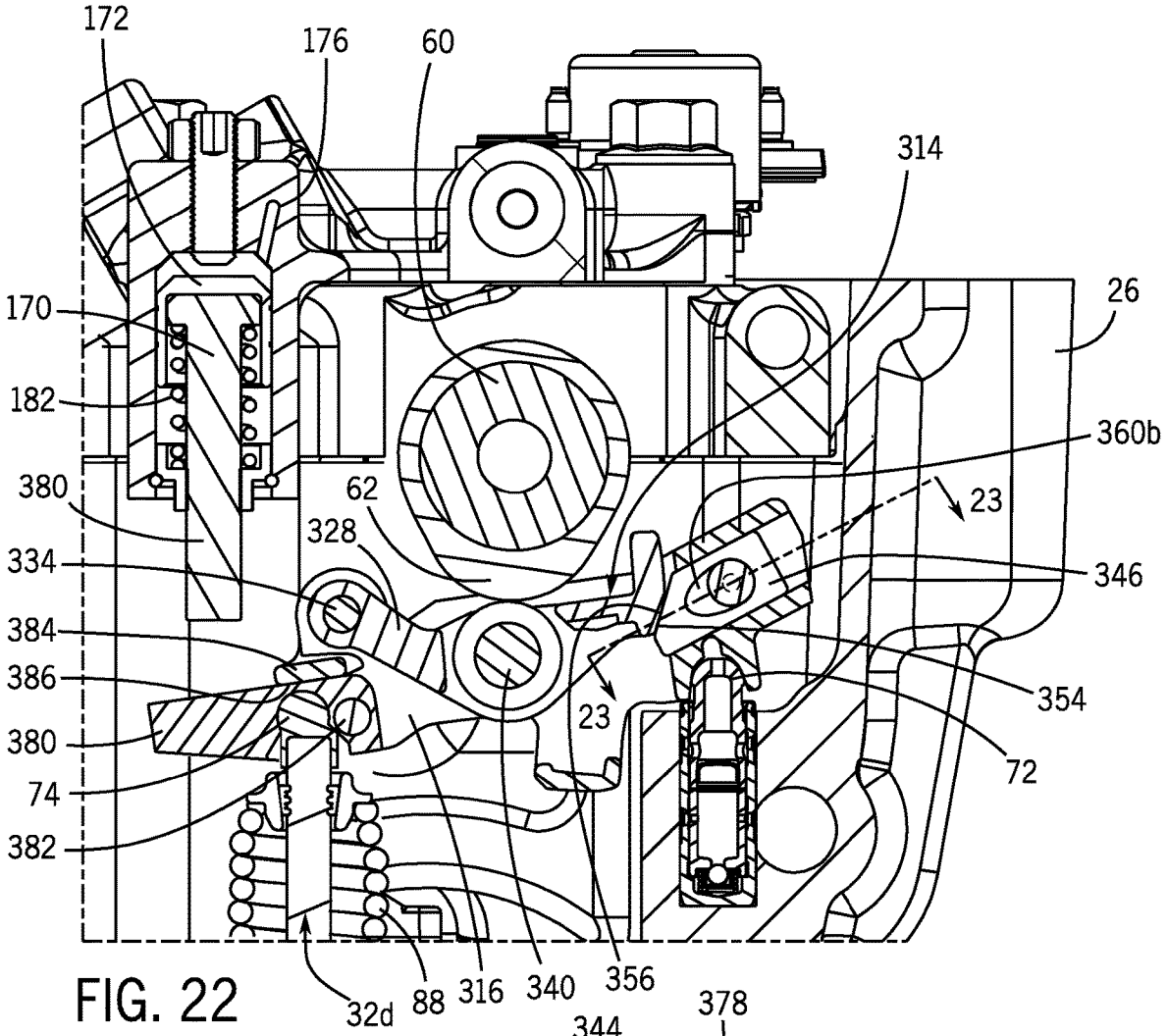
FIG. 22 is an enlarged sectional view of area 22-22 of FIG. 17, but showing a latch of the example switchable valve actuator in a locked position.
Figure 23:
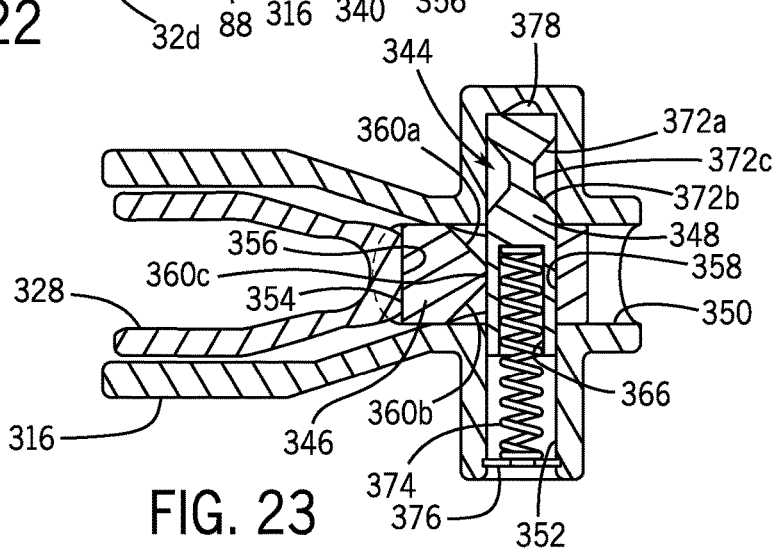
FIG. 23 is a sectional view along line 23-23 in FIG. 22.
Figure 24:
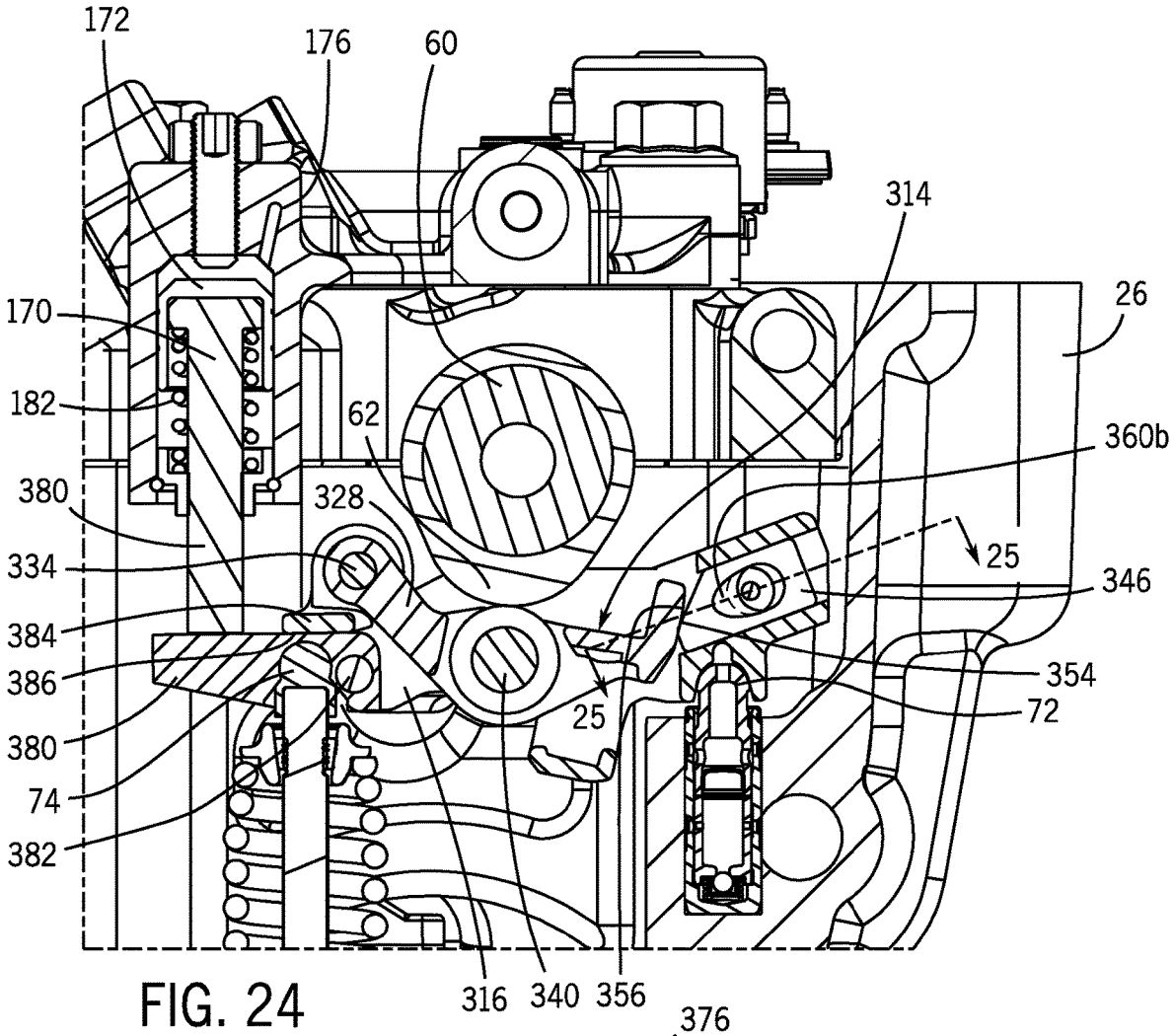
FIG. 24 is an enlarged sectional view similar to FIG. 24, but showing the latch in an unlocked position.
Figure 25:
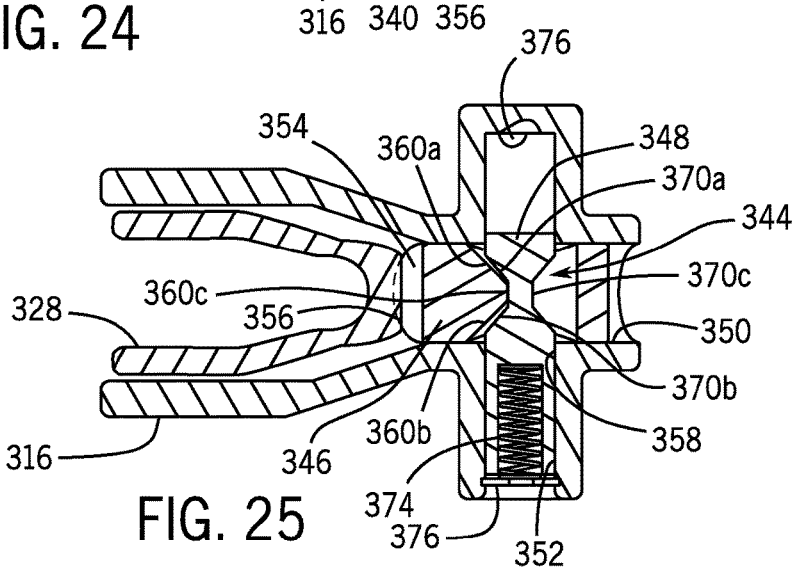
FIG. 25 is a sectional view along line 25-25 in FIG. 24.

The follower section 328 can be locked into a fixed angular position by a latch 344, see FIGS. 22 and 23, such that the follower section 328 (or a portion thereof) is parallel to the longitudinal axis 336, or the latch 344 can be unlocked such that the follower section 328 can pivot relative to the longitudinal axis 336, see FIGS. 24 and 25. In the locked position, the outer surface of the roller 340 contacts the portion of the camshaft 60 that has the valve cam lobe 62 and transmits a force to the follower section 328, thereby causing the follower section 316 to pivot. In the unlocked position, FIG. 24, the outer surface of the roller 340 contacts the portion of the camshaft 60 that has the valve cam lobe 62, and the follower section 328 pivots relative to the follower section 316 such that any motion by the camshaft 60 is absorbed, and the follower section 316 does not pivot relative to the pivot 74. The latch 344 includes a latch piece 346, which extends parallel to the longitudinal axis 336 of the follower section 316, and a locking piston 348, which extends perpendicular to the longitudinal axis 336. The latch piece 346 is positioned within a passageway 350 in the follower section 316 that extends along the longitudinal axis 336, and the locking piston 348 is positioned within a blind bore 352 in the follower section 316 that extends perpendicular to the longitudinal axis 336. The latch piece 346 is displaceable in a direction along the longitudinal axis 336 upon movement of the locking piston 348 in a direction perpendicular to the longitudinal axis 336. The latch piece 346 has an angled end surface 354 that is in contact with an angled end surface 356 at the first end 330 of the follower section 328 to lock the movement of the follower section 328 relative to the follower section 316. The end surfaces 354, 356 are angled relative to the longitudinal axis 336. The latch piece 346 has a passageway 358 therethrough that extends perpendicularly with respect to a longitudinal axis of the latch piece 346 and the longitudinal axis 336. The passageway 358 is elongated along its longitudinal axis, and the locking piston 348 passes through the passageway 358. Internal surfaces 360*a*, 360*b*, which define a portion of the wall forming the passageway 358, are angled and connected together by a planar surface 360*c* at the ends thereof, and define a restricted portion of the passageway 358. The locking piston 348 is elongated having first and second opposite ends 362, 364 and a blind bore 366 extending from the first end 362 toward the second end 364. An outer surface 368 of the locking piston 348 is cylindrical with the exception of a reduced diameter portion 370 provided between the ends 362, 364. The locking piston 348 has a diameter which is less than a longitudinal length of the passageway 358. The reduced diameter portion 370 has angled surfaces 372*a*, 372*b* connected together by a planar surface 372*c* at the ends thereof. A spring 374 is positioned within the blind bore 366 and in the blind bore 352 is held in place by a retaining member 376 within the blind bore 352. A hydraulic fluid (via a passage or line (not shown)) is brought to the follower section 316 and routed therethrough via an internal passage 378 to the blind bore 366.

Figure 20:
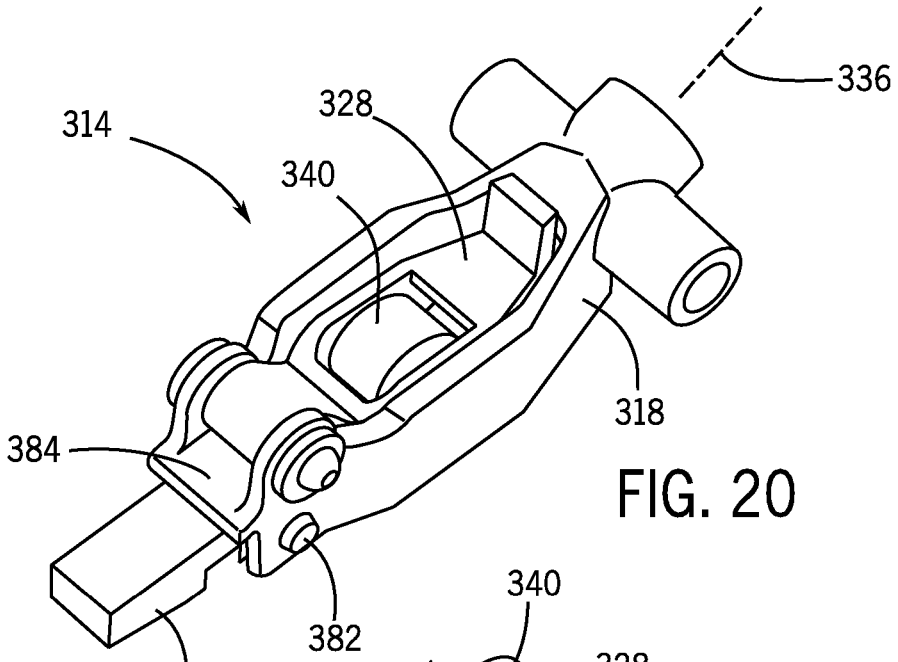
FIGS. 20 and 21 are isometric views of another example switchable valve actuator component used in certain examples of the Type II valvetrain.
Figure 21:
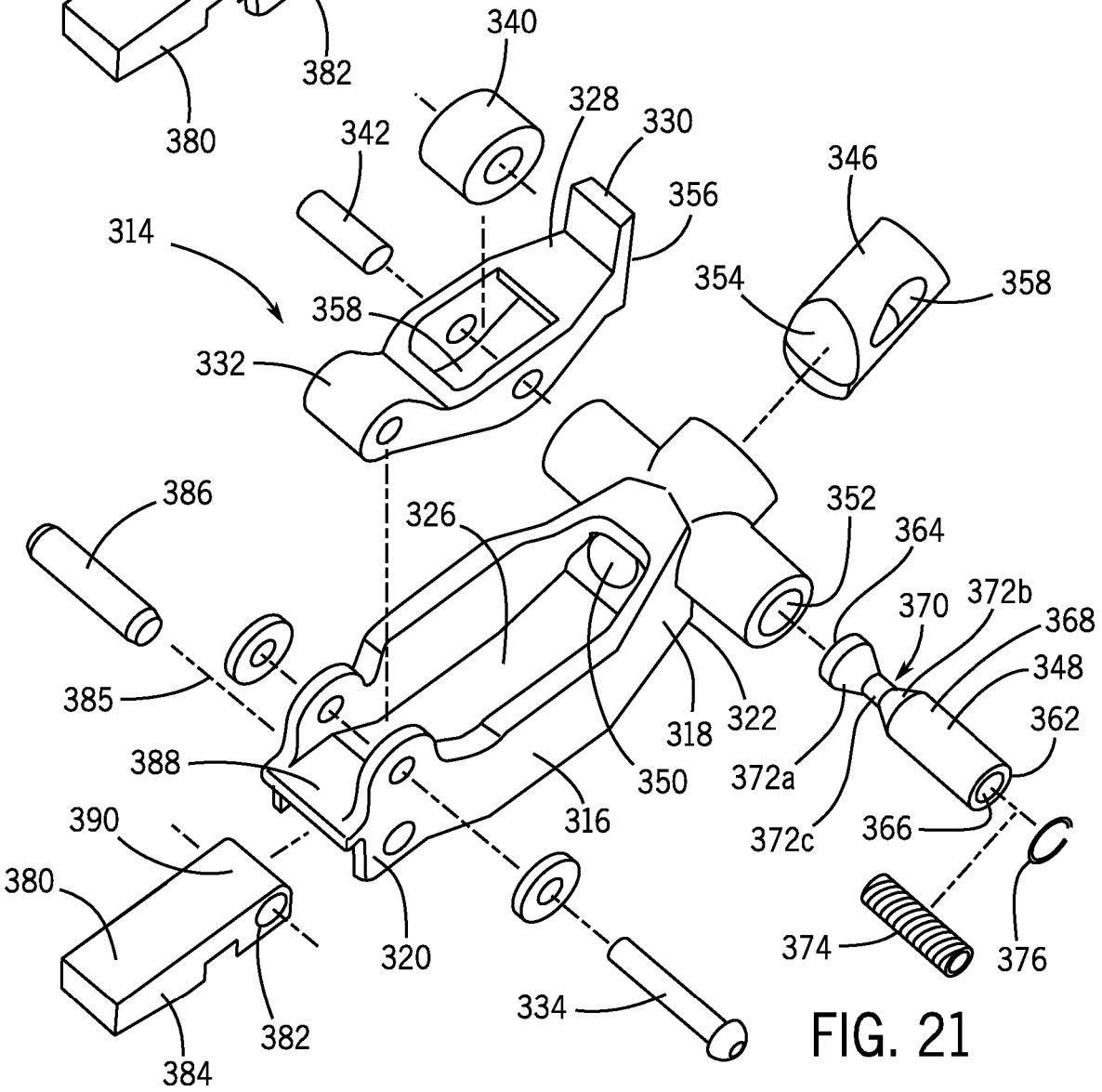

Each SRFFF 314, see FIGS. 20 and 21, is formed in the same manner as each SRFF 312, except that another elongated follower section 380 having first and second ends 382, 384 is pivotally coupled to the second end 320 of the follower section 316 about a fulcrum axis 385 defined by a pin 386, and the second end 320 of the follower section 316 is modified to include a stop tab 388 extending longitudinally therefrom. The first end 318 of the follower section 316 defines a first end, the second end 320 of the follower section 316 defines a first intermediate end, the first end 382 of the follower section 380 defines a second intermediate end, and the second end 384 of the follower section 380 defines a second end. The fulcrum axis 385 defined by the pin 386 is perpendicular to a longitudinal axis of the follower section 380 defined between the ends 382, 384. The stop tab 388 overlaps a portion 390 of the upper surface of the follower section 380 and is configured to engage the portion 390 to limit rotation of the follower section 380 in one clock direction (clockwise in the figures) about the fulcrum axis 385 defined by the pin 386 when the follower section 380 is in contact with the stop tab 388. The valve cam lobe 62 on the exhaust camshaft 60 is configured to contact the roller 340 during rotation of the exhaust camshaft 60. When the brake piston 170 is in the non-activated position, the first follower section 316 transmits a lash adjustment force from the pivot 74 to the second follower section 380, which transmits the lash adjustment force to the cylinder valve 34*d*.

Under normal operation of the ICE 12, the latch 344 is in a locked position, as shown in FIG. 23. The end surface 354 of the latch piece 346 is in contact with the end surface 356 of the of the follower section 328, and the planar surface 360*c* of the latch piece 346 is in contact with the outer surface 368 of the locking piston 348. When the latch 344 is in the locked position, the follower section 328 cannot pivot relative to the follower section 316. Therefore, when the valve cam lobes 58, 62 engage with the associated roller 340, the follower sections 316 pivot about pivot 74 and open the cylinder valves 34*a*, 34*b*, 34*c*. To unlock the latch 344, hydraulic fluid is supplied into the blind bore 366 and against the second end 364 of the locking piston 348. The locking piston 348 moves toward the retaining member 376, thereby causing the spring 374 to compress and causing the reduced diameter portion 370 to align with the passageway 350. When the valve cam lobe 58, 62 engages sufficiently with the roller 340, the follower section 328 pivots relative to the follower section 316, which causes the latch piece 346 to move longitudinally and into the reduced diameter portion 370 such that Internal surfaces 360*a*, 360*b*, 360*c* seat against surfaces 372*a*, 372*b*, 372*c*. The end surface 354 remains below the end surface 356 to provide to limit rotation of the follower section 328 (clockwise in the figures) about the hinge axis 385 defined by the pin 334. When the pressure is no longer being applied by hydraulic fluid against the second end 364 of the locking piston 348, the spring 374 extends and the locking piston 348 moves away from the retaining member 376 to the locked position. The angled surface 372*b* of the locking piston 348 engages against angled surface 360*b* of the latch piece 346 which causes latch piece 346 to move longitudinally away from the blind bore 352 and the end surface 354 of the latch piece 346 engages against the end surface 356 of the follower section 328 and causes the follower section 328 to pivot back into alignment with the longitudinal axis 336.

To activate the CDA, the SRFFs 312 and the SRFFFs 314 are moved to the unlocked position, such that the follower section 328 is configured to pivot relative to the follower section 316 when the valve cam lobe 58, 62 contacts the roller 340 as described herein. This can be done under solenoid valve control. Since the motion of the valve cam lobes 58, 62 are absorbed by the SRFFs 312 and the SRFFF 314, the engine cylinder 28 has been deactivated.

The engine brake arrangement 310 also allows for enhanced engine braking, sometimes referred to as 1.5 stroke braking, in that a second compression release event may be achieved after the initial compression release event, which may be at top dead center (TDC) of the compression stroke prior to what would normally be the power stroke of the cycle. The second compression release event may be achieved by maintaining the exhaust valve 32*d* closed during the exhaust upstroke by unlocking the SRFFs 312 and the SRFFF 314 to create a secondary compression and then opening the exhaust valve 32*d* by activating the engine brake assembly 80 under control of the solenoid valve 184 to release the secondary compression at TDC of the exhaust stroke. This additional compression release event thus allows for additional energy to be dissipated through the engine, and with lower valve lift values, as compared to conventional engine braking.

Figure 26:
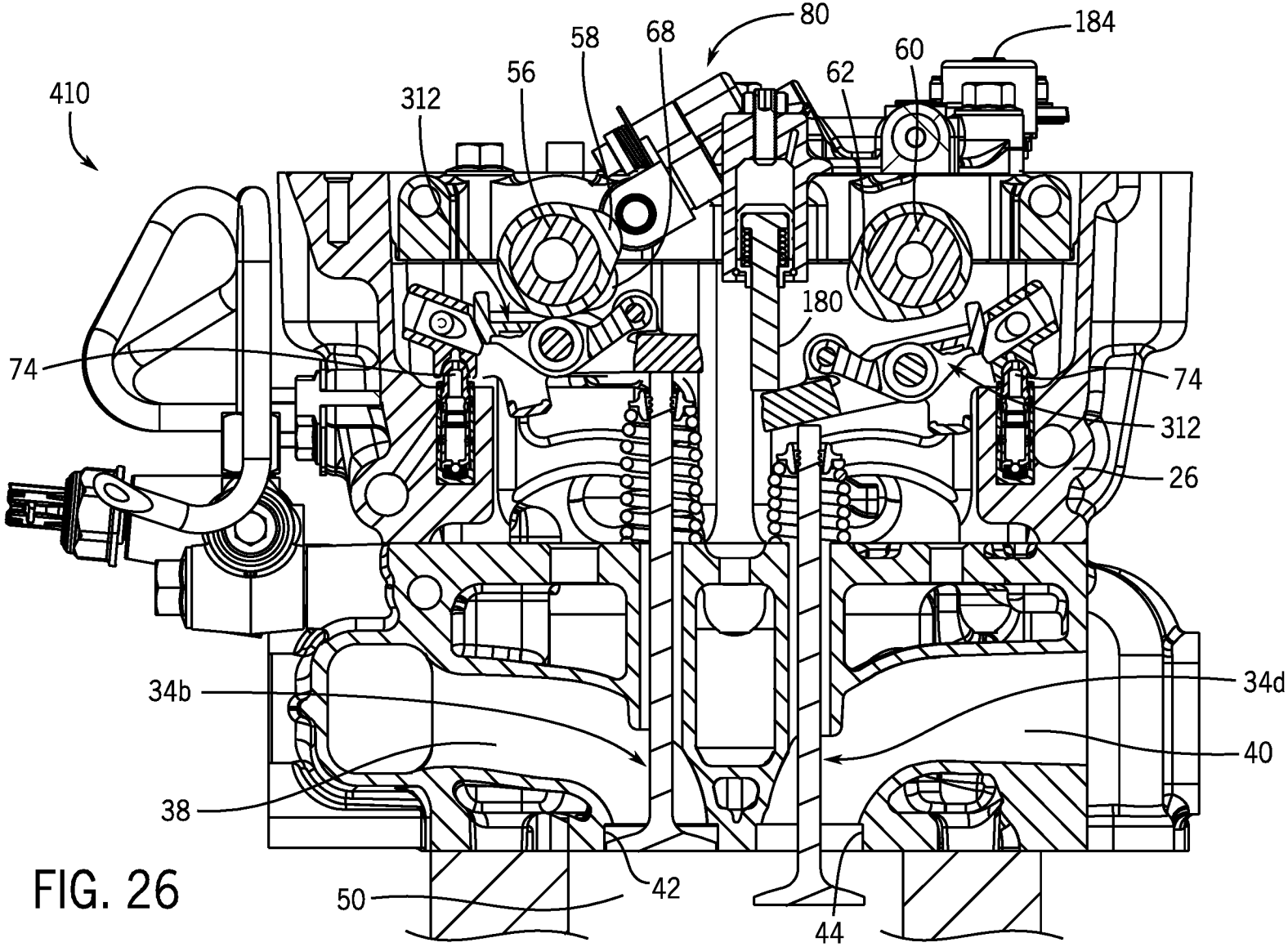
FIG. 26 is a sectional view of another example implementation of a Type II valvetrain and engine brake arrangement.

FIG. 26 illustrates another example implementation of a Type II valvetrain and engine brake arrangement 410 with braking and CDA in which each SRFFF 314 is replaced by a SRFF 312 such that only SRFFs 312 are utilized. The first end 318 of the SRFF 312 is configured to interact with the pivot 74, and the second end 320 is configured to interact with the valve stem 82 of the exhaust cylinder valve 34*d* and with the brake rod 180 (the second end 320 may be elongated to accommodate the engagement with the valve stem 82). During engine braking operation, the SRFF 312 is in the locked position and the interaction between the contact surface 322 and the pivot 74 causes the SRFF 312 to pivot relative to the valve block 26 about the pivot axis 100. The outer surface of the roller 340 contacts the portion of the camshaft 60 that has the valve cam lobe 62 and transmits force to pivot the SRFF 312. At or near the end of the compression stroke, or otherwise between the compression stroke and the expansion, the glide surface 178 on the follower piston 166 contacts the brake cam lobe 68 sufficiently to cause the follower piston 166 to move within the brake housing 162 and effectively decrease the size of the follower piston chamber 168. This forces the hydraulic fluid out of the follower piston chamber 168, through the hydraulic passage 164, through the hydraulic passage 176 and into the brake piston chamber 172, thereby driving the brake rod 180 downwardly into the activated position and into engagement with the upper surface of the second end 94. The second end 320 of the SRFF 312 pivots downward, which causes the force of the spring 88 of the cylinder valve 34*d* to be overcome, and the cylinder valve 34*d* lifts off of its seat 44, thereby effecting a decompression event by exhausting gases out of the combustion chamber 50. When the brake cam lobe 68 rotates sufficiently away from the glide surface 178, the spring 88 of the cylinder valve 34*d* resumes its natural extended condition and causes the SRFF 312 to pivot upward about its pivot 74, and moves the brake rod 180 and brake piston 170 upwardly. This moves the brake rod 180 to the non-activated position, causing the hydraulic fluid to flow out of the brake piston chamber 172, through the hydraulic passage 176, through the hydraulic passage 164, back into the follower piston chamber 168, and the follower piston 166 and the glide surface 178 move away from the brake housing 162. To accommodate the pivoting of the SRFF 312 during engine braking, the SRFF 312 will pivot to a position of complete disengagement from the camshaft 60 and valve cam lobe 62 under action of the brake rod 180. The braking cam lobe 62 will re-engage the RFF 72 to the primary cam lobe after the braking valve motions are accomplished. Here again, the centerline of the valve stem 82 of the valve 32*d* is between the centerline of the brake rod 180 acting on the SRFF 312 and the contact region of the valve cam lobe 62. To allow the pivot 74 to move, see FIG. 11, the check valve 140 is opened to allow the housing 134 to reciprocate relative to the plunger 138.

The foregoing describes one or more example engine and valvetrain and engine brake arrangements in detail. Various other configurations are possible within the scope of this disclosure.

ENUMERATED EXAMPLES

Also, the following examples are provided, which are numbered for easier reference.

1. A Type II valvetrain and engine brake arrangement including: a brake housing mountable within a valve block of the engine and defining, at least in part, a hydraulic circuit, the brake housing defining a follower piston chamber and a brake piston chamber in communication with the hydraulic circuit; a follower piston disposed in the follower piston chamber and a brake piston disposed in the brake piston chamber, the follower piston configured to follow a rotating brake cam lobe, the brake piston being in pressure responsive relation with the follower piston to move into an activated position; a brake rod coupled to the brake piston; and a finger follower with a first end and a second end, the finger follower disposed relative to the brake housing so that the brake rod engages the finger follower at least when the brake piston is in the activated position; wherein, when the brake piston is in a non-activated position, the finger follower is configured to pivot from the first end about a pivot as the finger follower follows a valve cam lobe to effect lifting and seating of a cylinder valve of an engine cylinder; and wherein, when the brake piston is in the activated position, the finger follower, at least in part, pivots from the first end about the pivot and the brake rod fixes the second end of the finger follower to lift the cylinder valve and release compression from the engine cylinder.

2. The arrangement of example 1, wherein the finger follower includes: a first follower section defining the first end of the finger follower; and a second follower section defining the second end of the finger follower and pivotally coupled to the first follower section about a hinge axis; wherein the first follower section pivots about the hinge axis relative to the second follower section when the brake piston is in the activated position; and wherein the first follower section does not pivot about the hinge axis relative to the second follower section when the brake piston is in the non-activated position.

3. The arrangement of example 2, wherein the first follower section defines a first intermediate end of the finger follower and a fulcrum that defines the hinge axis, the fulcrum being closer to the first end of the finger follower than the first intermediate end.

4. The arrangement of example 3, wherein the second follower section defines a second intermediate end of the finger follower and pivotally engages the fulcrum.

5. The arrangement of example 4, wherein the first follower section includes a stop tab extending axially with respect to the hinge axis and between the first intermediate end and the fulcrum to engage the second follower section and limit rotation of the first follower section about the hinge axis relative to the second follower section in at least one clock direction.

6. The arrangement of example 2, wherein the finger follower includes a roller rotatably coupled to the first follower section and in rolling engagement with the valve cam lobe at least when the brake piston is in the non-activated position.

7. The arrangement of example 2, wherein the pivot is defined by a lash adjuster mounted to the valve block; and wherein, when the brake piston is in the non-activated position, the first follower section transmits a lash adjustment force from the lash adjuster to the second follower section, which transmits the lash adjustment force to the cylinder valve.

8. The arrangement of example 7, wherein the lash adjuster includes a housing fixed relative to the valve block and a plunger that is movable relative to the housing along a lash adjuster axis; and wherein the plunger defines the pivot, which is held fixed at an adjusted position.

9. The arrangement of example 2, wherein the finger follower includes: a latch; and a pivotal third follower section disposed to be engaged by and disengaged from the latch; wherein the latch is movable to unlatch the third follower section such that the finger follower is configured to maintain a fixed position of the cylinder valve as the valve cam lobe rotates; and wherein the latch is movable to latch the third follower section such that the finger follower is configured to effect reciprocal lifting and seating of the cylinder valve as the valve cam lobe rotates.

10. The arrangement of example 9, wherein the first follower section includes a second fulcrum at the first intermediate end defining a second hinge axis; wherein the third follower section is pivotally coupled to the first follower section along the second hinge axis.

11. The arrangement of example 10, wherein the latch includes a locking piston; and wherein the finger follower is coupled to the hydraulic circuit of the engine and the locking piston is driven by hydraulic pressure to move the latch.

12. The arrangement of example 1, further including a solenoid valve operable to control pressurization of the hydraulic circuit within the brake housing.

13. An engine including: an engine crankcase housing one or more engine cylinders each containing an engine piston; a valve block mounted to the engine crankcase and defining a plurality of valve openings in communication with each of the one or more engine cylinders, the valve block housing a Type II valvetrain including: a plurality of camshafts with a plurality of cam lobes disposed above the one or more engine cylinders, the plurality of cam lobes including at least one brake cam lobe and multiple valve cam lobes; a plurality of valves operable to open and close the plurality of valve openings of the one or more engine cylinders; a plurality of pivots; and a plurality of finger followers configured to pivot about the plurality of pivots and follow the valve cam lobes to effect lifting and seating of the plurality of valves with respect to the plurality of valve openings; and an engine brake including: a brake housing mounted within the valve block and defining, at least in part, a hydraulic circuit and a follower piston chamber and a brake piston chamber in communication with the hydraulic circuit; a follower piston disposed in the follower piston chamber and a brake piston disposed in the brake piston chamber, the follower piston configured to follow the at least one brake cam lobe, the brake piston being in pressure responsive relation with the follower piston to move into an activated position; and a brake rod coupled to the brake piston and configured to engage an associated one of the plurality of finger followers at least when the brake piston is in the activated position; wherein, when the brake piston is in a non-activated position, the associated finger follower is configured to pivot about an associated one of the plurality of pivots as the associated finger follower follows an associated one of the valve cam lobes to effect lifting and seating of an associated one of the plurality of valves; and wherein, when the brake piston is in the activated position, the brake rod lifts the cylinder valve and releases compression from the engine cylinder valve as the associated finger follower follows the associated valve cam lobe to release compression from an associated one of the one or more engine cylinders.

14. The engine of example 13, wherein the associated finger follower includes: a first follower section defining a first end of the associated finger follower; a second follower section defining a second end of the associated finger follower and pivotally coupled to the first follower section about a hinge axis; and a roller rotatably coupled to the first follower section and in rolling engagement with the associated valve cam lobe at least when the brake piston is in the non-activated position; wherein the first follower section pivots about the hinge axis relative to the second follower section when the brake piston is in the activated position; and wherein the first follower section does not pivot about the hinge axis relative to the second follower section when the brake piston is in the retracted position.

15. The engine of example 13, wherein the first follower section defines a first intermediate end of the associated finger follower and a fulcrum that defines the hinge axis, the fulcrum being closer to the first end of the associated finger follower than the first intermediate end; and wherein the second follower section defines a second intermediate end of the associated finger follower and pivotally engages the fulcrum.

CONCLUSION

The one or more examples discussed above result in an engine with an end pivot Type II valvetrain architecture having compression release engine braking capabilities. The disclosed hydraulic brake arrangement maybe implemented as a brake manifold with piston pairs that operate in a pressure responsive manner (e.g., master/slave) such that a follower piston may cooperate with a brake piston via hydraulic pressure to apply the engine brake. Selective operation may be achieved by electronic (e.g., solenoid valve) control of the hydraulic pressure within the brake manifold. The brake piston may physically engage a finger follower of various types to apply the engine brake. Depending on the finger follower configuration the braked valve may also be operated to provide hydraulic lash adjustment and/or cylinder activation, thereby allowing engine breaking as well as improved valve seating (reduced valvetrain/noise-chatter) and engine performance in an end pivot Type II valvetrain engine architecture.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A Type II valvetrain and engine brake arrangement comprising:

a hydraulic brake housing mountable to a valve block of the engine;

a brake piston coupled to a brake rod and a brake cam lobe and movable between an activated position and a non-activated position; and a finger follower disposed relative to the brake housing so that the brake rod engages the finger follower at least when the brake piston is in the activated position;

wherein, when the brake piston is in a non-activated position, the finger follower is configured to pivot about a pivot as the finger follower follows a valve cam lobe to effect lifting and seating of a cylinder valve of an engine cylinder; and wherein, when the brake piston is in the activated position, the finger follower, at least in part, pivots from about the pivot and the brake rod engages the finger follower to lift the cylinder valve and release compression from the engine cylinder.

2. The arrangement of claim 1, wherein the hydraulic brake housing defines, at least in part, a hydraulic circuit and a follower piston chamber and a brake piston chamber in communication with the hydraulic circuit.

3. The arrangement of claim 2, further including a follower piston disposed in the follower piston chamber configured to follow the brake cam lobe;

wherein the brake piston is disposed in the brake piston chamber in pressure responsive relation with the follower piston to move into the activated position.

4. The arrangement of claim 2, further including a solenoid valve operable to control pressurization of the hydraulic circuit within the brake housing.

5. An engine comprising:

an engine crankcase housing an engine cylinder containing an engine piston;

a valve block mounted to the engine crankcase and defining a valve opening in communication with the engine cylinder, the valve block housing a Type II valvetrain including a pivot and a camshaft with a brake cam lobe and a valve cam lobe disposed above the engine cylinder; and an engine brake including:

a hydraulic brake housing mountable to the valve block;

a brake piston coupled to a brake rod and the brake cam lobe and movable between an activated position and a non-activated position; and a finger follower disposed relative to the brake housing so that the brake rod engages the finger follower at least when the brake piston is in the activated position;

wherein, when the brake piston is in a non-activated position, the finger follower is configured to pivot about the pivot as the finger follower follows the valve cam lobe to effect lifting and seating of a cylinder valve of the engine cylinder; and wherein, when the brake piston is in the activated position, the finger follower, at least in part, pivots from about the pivot and the brake rod engages the finger follower to lift the cylinder valve and release compression from the engine cylinder.

6. The engine of claim 5, wherein the hydraulic brake housing defines, at least in part, a hydraulic circuit and a follower piston chamber and a brake piston chamber in communication with the hydraulic circuit.

7. The engine of claim 6, further including a follower piston disposed in the follower piston chamber configured to follow the brake cam lobe;

wherein the brake piston is disposed in the brake piston chamber in pressure responsive relation with the follower piston to move into the activated position.

8. The engine of claim 6, further including a solenoid valve operable to control pressurization of the hydraulic circuit within the brake housing.

* * * * *